US008936338B2

(12) United States Patent
Saito et al.

(10) Patent No.: US 8,936,338 B2
(45) Date of Patent: Jan. 20, 2015

(54) APPARATUS AND METHOD FOR RECORDING

(75) Inventors: Hiroyuki Saito, Yokohama (JP); Takaaki Ishida, Kawasaki (JP); Koichiro Kawaguchi, Yokohama (JP); Toshirou Yoshiike, Kawasaki (JP); Jun Yasutani, Kawasaki (JP); Shuichi Tokuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/543,625

(22) Filed: Jul. 6, 2012

(65) Prior Publication Data

US 2012/0268516 A1 Oct. 25, 2012

Related U.S. Application Data

(62) Division of application No. 12/542,847, filed on Aug. 18, 2009, now Pat. No. 8,235,492.

(30) Foreign Application Priority Data

Aug. 25, 2008 (JP) ..... 2008-215700

(51) Int. Cl.
*B41J 29/38* (2006.01)

(52) U.S. Cl.
USPC ..... 347/16; 400/629; 400/634

(58) Field of Classification Search
USPC ..... 347/5, 9, 16, 15; 400/634, 629
See application file for complete search history.

(56) References Cited

U.S. PATENT DOCUMENTS

| | | | | |
|---|---|---|---|---|
| 5,725,319 | A * | 3/1998 | Saito et al. | 400/629 |
| 7,934,787 | B2 * | 5/2011 | Yoshida | 347/16 |
| 2003/0222932 | A1 * | 12/2003 | Lee et al. | 347/16 |
| 2005/0053408 | A1 * | 3/2005 | Otsuka | 400/634 |

FOREIGN PATENT DOCUMENTS

JP 2004-123313 A 4/2004

* cited by examiner

*Primary Examiner* — Lam S Nguyen
(74) *Attorney, Agent, or Firm* — Canon U.S.A., Inc. IP Division

(57) ABSTRACT

A recording apparatus has a controller that controls a conveying roller and a discharge roller for conveying a recording medium. The controller controls the rotation phases of the conveying roller and the discharge roller when the recording medium leaves the conveying roller before the recording medium enters the conveying roller.

7 Claims, 22 Drawing Sheets

| | CORRECTION VALUE | | |
|---|---|---|---|
| | CONVEYING ROLLER REGION | DISCHARGE ROLLER REGION | TIME OF TRANSFER |
| S1 | SLF1 | SEJ1 | SK1 |
| S2 | SLF2 | SEJ2 | SK2 |
| S3 | SLF3 | SEJ3 | SK3 |
| S4 | SLF4 | SEJ4 | SK4 |
| S5 | SLF5 | SEJ5 | SK5 |
| S6 | SLF6 | SEJ6 | SK6 |
| S7 | SLF7 | SEJ7 | SK7 |
| S8 | SLF8 | SEJ8 | SK8 |

| | CORRECTION VALUE | | |
|---|---|---|---|
| | CONVEYING ROLLER REGION | DISCHARGE ROLLER REGION | TIME OF TRANSFER |
| S1 | SLF1 | SEJ1 | SK1 |
| S2 | SLF2 | SEJ2 | SK2 |
| S3 | SLF3 | SEJ3 | SK3 |
| S4 | SLF4 | SEJ4 | SK4 |
| S5 | SLF5 | SEJ5 | SK5 |
| S6 | SLF6 | SEJ6 | SK6 |
| S7 | SLF7 | SEJ7 | SK7 |
| S8 | SLF8 | SEJ8 | SK8 |

APPARATUS AND METHOD FOR RECORDING

CROSS-REFERENCE TO RELATED APPLICATIONS

This application is a divisional of application Ser. No. 12/542,847, filed on Aug. 18, 2009, which claims priority from Japanese Patent Application No. 2008-215700 filed Aug. 25, 2008, which are hereby incorporated by reference herein in their entirety.

BACKGROUND OF THE INVENTION

1. Field of the Invention

The present invention relates to a recording apparatus and a method for recording, and more specifically, it relates to a technique to correct a recording medium conveyance amount error used in an ink jet recording apparatus.

2. Description of the Related Art

In an ink jet printer, a high-precision roller that is a metal shaft coated with grindstone has been used as a main conveying roller, and a DC motor has been controlled using a position detecting unit (a code wheel and an encoder sensor) provided on the axis of the roller. Thus, in an ink jet printer, a recording medium (paper) can be conveyed with a high degree of accuracy, and a high-quality image can be recorded. However, improving the paper conveyance accuracy by improving the accuracy of processing of the conveying roller is approaching a limit. To solve this problem, recently, for example, roller eccentricity correction has been performed.

The eccentricity correction will be briefly described. When a conveying roller has a circular cross-sectional shape and the central axis thereof corresponds to the rotation axis, and when the roller rotation angle for paper conveyance is uniform, the length in the circumferential direction (the length of an arc) when the roller is rotated is constant. Therefore, the conveyance amount of a recording medium conveyed in contact with the roller is constant. However, when a conveying roller has an elliptic cross-sectional shape, the conveyance amount per given rotation angle of the roller varies depending on the rotational position (rotation phase) of the roller. That is to say, there are regions where the conveyance amount is larger than a predetermined amount and regions where the conveyance amount is smaller than the predetermined amount, depending on the rotation phase of the roller, and the conveyance amount error fluctuates. In the eccentricity correction, the conveyance amount correction value of each rotation phase of the roller is obtained, and the conveyance amount error fluctuating depending on the rotation phase is corrected. In the following description, a conveyance amount when a roller is rotated by a given angle will be also referred to as unit conveyance amount.

A discharge roller disposed downstream of the conveying roller conveys paper after ink is shot onto the paper. For this purpose, the discharge roller is provided with a star-shaped driven roller called spur. The discharge roller is formed of an elastic material (rubber) so as not to damage the spikes of the spur. Even if the eccentricity correction is performed, the same paper conveyance accuracy as the conveying roller cannot be maintained.

What is especially important for paper conveyance accuracy is the conveyance amount at the time of transfer from the conveying roller to the discharge roller. That is to say, the paper conveyance accuracy at the time of switching from a state where paper is conveyed by both the conveying roller and the discharge roller to a state where paper is conveyed only by the discharge roller, is important. It is known that the accuracy of the conveying operation at this time is generally lower than the accuracy of the first conveying operation due to various factors such as deflection of roller shaft and instability when paper leaves the conveying roller in addition to the factor of roller precision error. Japanese Patent Laid-Open No. 2005-7817 discloses a technique to reduce the reduction in conveyance accuracy at the time of transfer from the conveying roller to the discharge roller. In this technique, the conveyance amount correction value at the time of transfer is obtained using a test pattern, and the conveyance amount at the time of transfer is corrected using the obtained correction value.

As described above, due to the roller eccentricity, the conveyance amount error fluctuates depending on the roller rotation phase. This phenomenon also occurs in the conveying operation at the time of transfer. Depending on the rotation phase of the conveying roller and the rotation phase of the discharge roller at the time of transfer, the error in conveyance amount at the time of transfer also fluctuates.

However, in the method of Japanese Patent Laid-Open No. 2005-7817, the correction value of conveyance amount at the time of transfer is a fixed value, and in the conveying operation at the time of transfer, the correction control of conveyance amount is always performed using the fixed correction value. Therefore, in the conveying operation at the time of transfer, the roller rotation phase varies by conveying operation. If the error in conveyance amount at the time of transfer fluctuates depending on the rotation phase, the error cannot be accurately corrected.

SUMMARY OF THE INVENTION

According to an aspect of the present invention, a recording apparatus records an image on a recording medium by repeatedly performing an operation to make a recording head scan in a scanning direction and an operation to convey the recording medium in a conveying direction perpendicular to the scanning direction. The apparatus includes a first conveying roller that is disposed upstream of the recording head in the conveying direction and conveys the recording medium, a second conveying roller that is disposed downstream of the recording head in the conveying direction and conveys the recording medium, and a controller that controls the operation to convey the recording medium using the first conveying roller and the second conveying roller. The controller controls rotation phases of the first conveying roller and the second conveying roller in a third conveying operation to transit from a first conveying operation to convey the recording medium using the first conveying roller and the second conveying roller to a second conveying operation to convey the recording medium using the second conveying roller without using the first conveying roller, before the recording medium enters the first conveying roller.

According to another aspect of the present invention, a method for recording an image on a recording medium by repeatedly performing an operation to make a recording head scan in a scanning direction and an operation to convey the recording medium in a conveying direction perpendicular to the scanning direction, includes the step of controlling the operation to convey the recording medium, using a first conveying roller that is disposed upstream of the recording head in the conveying direction and conveys the recording medium, and a second conveying roller that is disposed downstream of the recording head in the conveying direction and conveys the recording medium. In the controlling step, rotation phases of the first conveying roller and the second conveying roller in a third conveying operation to transit from a first conveying operation to convey the recording medium using the first conveying roller and the second conveying roller to a second conveying operation to convey the recording medium using the second conveying roller without using the first conveying roller, are controlled before the recording medium enters the first conveying roller.

According to the present invention, the conveyance amount error can be corrected according to the roller rotation phase, in the conveying operation at the time of transfer from the conveying roller to the discharge roller, and therefore paper can be conveyed with a high degree of accuracy.

Further features of the present invention will become apparent from the following description of exemplary embodiments with reference to the attached drawings.

DESCRIPTION OF THE EMBODIMENTS

The embodiments of the present invention will now be described with reference to the drawings.

First Embodiment

Figure 1:
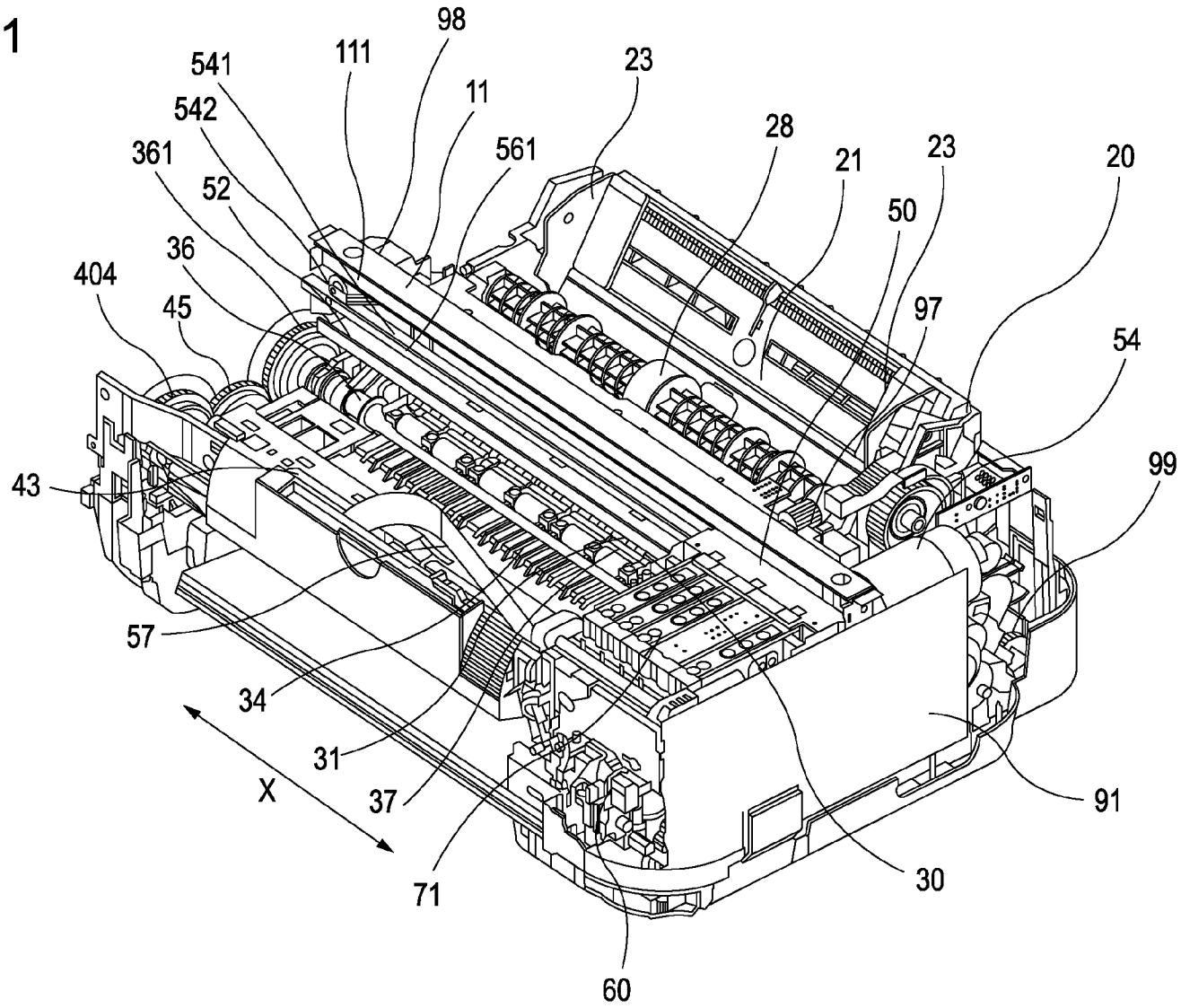
FIG. 1 is a perspective view of a mechanical section of a recording apparatus applicable to the present invention.

FIG. 1 is a perspective view of a mechanical section of a recording apparatus in this embodiment.

(A) Paper Feed Section

A paper feed section includes a paper feed section base 20, a pressing plate 21 on which recording media are loaded, a paper feed roller 28 that feeds sheets P of recording paper one at a time, a separating roller (not shown) that separates sheets P of recording paper, and a return lever (not shown) for returning recording media to a loading position. The pressing plate 21, the paper feed roller 28, the separating roller, and the return lever are attached to the paper feed section base 20. The pressing plate 21 is provided with movable side guides 23, which define the loading position of recording media. The pressing plate 21 is rotatable around a rotating shaft joined to the paper feed section base 20. The pressing plate 21 is urged toward the paper feed roller 28 by a pressing plate spring (not shown). The paper feed roller 28 has a circular cross section. The paper feed roller 28 rotates in contact with the surface of a recording medium, thereby feeding recording media to the inside of the apparatus. The recording media hit against the nip between the paper feed roller 28 and the separating roller and are separated by the nip, and only the uppermost recording medium is further conveyed to the inside. The paper feed roller 28 is rotated by the driving force of a paper feed motor 99 that serves as a paper feed driving unit. The driving force of the paper feed motor 99 is transmitted through a drive transmitting gear or a planetary gear. The driving force of the paper feed motor 99 is also transmitted to a cleaning section described below.

(B) Paper Conveying Section

The main mechanisms of a paper conveying section are attached to a sheet metal chassis 11 bent upward, and chassis 97 and 98 formed by molding. The recording medium sent to the paper conveying section is guided by a paper guide and a pinch roller holder 30 provided at the entrance of the paper conveying section, and is nipped by a roller pair of a conveying roller 36 and a pinch roller 37. The conveying roller 36 is a metal shaft coated with fine grains of ceramics. Both ends of the conveying roller 36 are supported by bearings attached to the chassis 11. The pinch roller holder 30 holds a plurality of pinch rollers 37 that are urged against the surface of the conveying roller 36 by a pinch roller spring 31. The pinch rollers 37 are in contact with the surface of the conveying roller 36 and are driven by the conveying roller 36.

Figure 2:
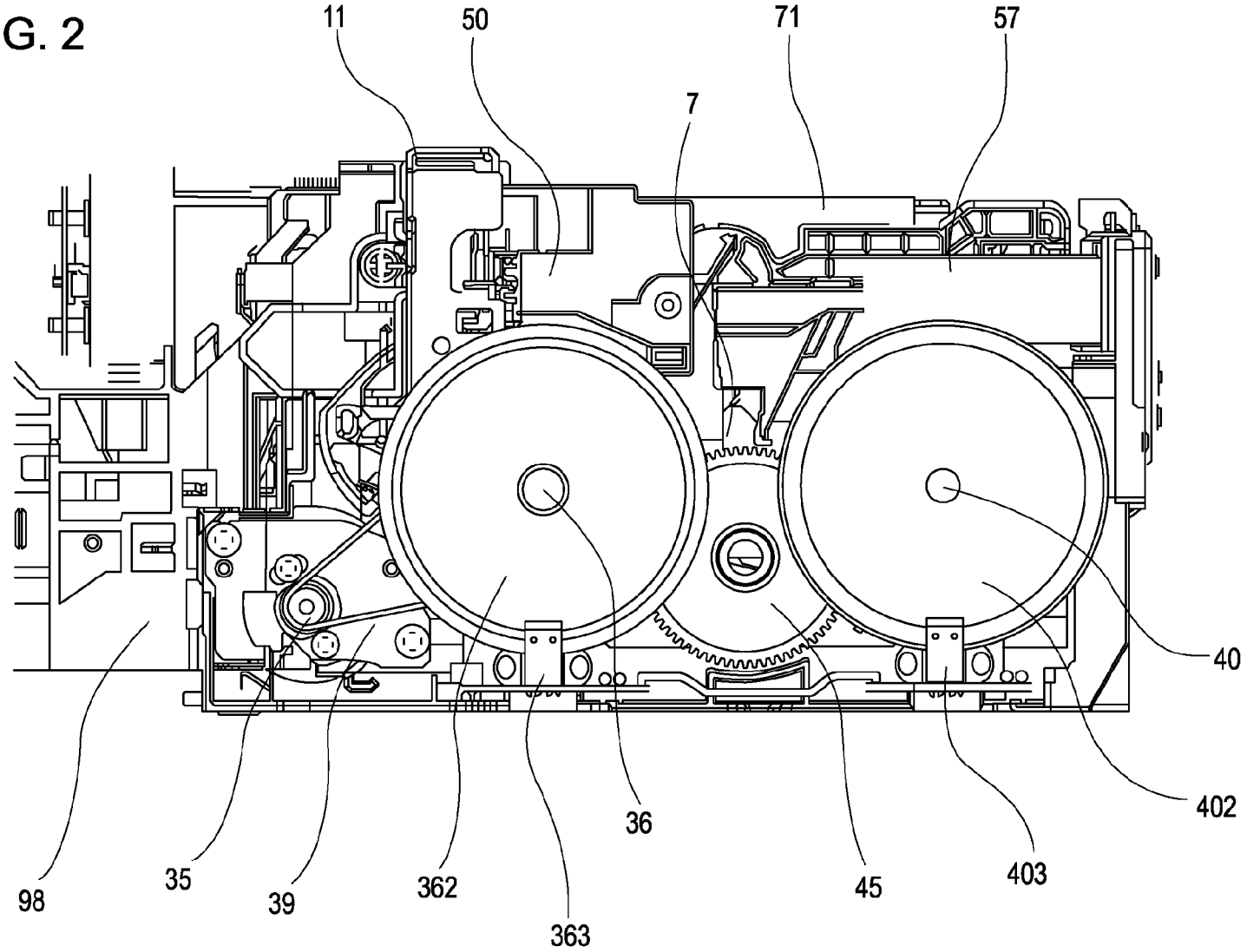
FIG. 2 is a sectional view for illustrating in detail a conveying mechanism including a paper conveying section in the recording apparatus of the present invention.
Figure 3:
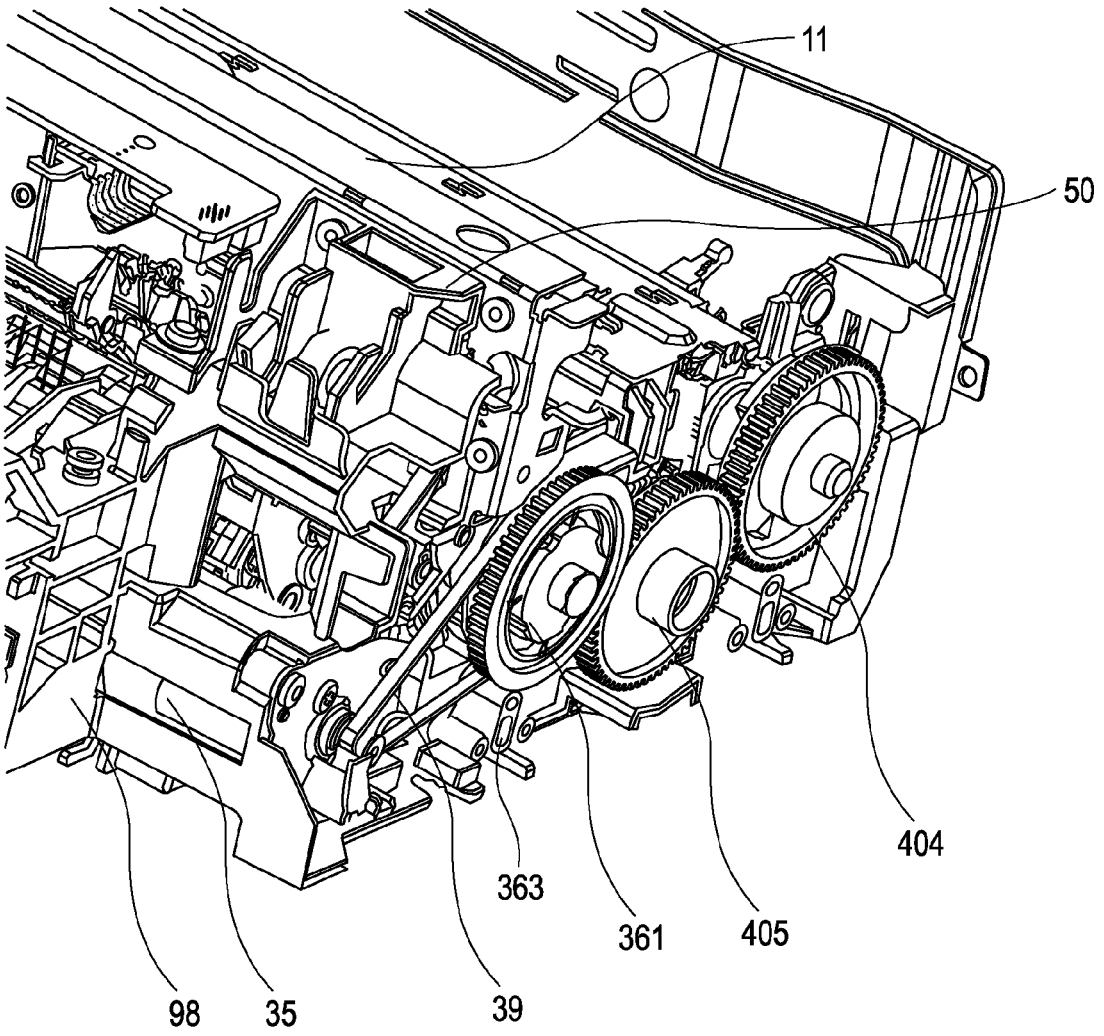
FIG. 3 is a perspective view for illustrating in detail a conveying mechanism including a paper conveying section in the recording apparatus of the present invention.

FIGS. 2 and 3 are a sectional view and a perspective view, respectively, for illustrating in detail a conveying mechanism including the paper conveying section in the recording apparatus of this embodiment. The conveying roller 36 is rotated by the driving force of a conveying motor 35 that is a DC motor. The driving force of the conveying motor 35 is transmitted through a timing belt to a pulley gear 361 provided on the axis of the conveying roller 36. A code wheel 362 is coaxially and directly connected to the conveying roller 36. The code wheel 362 has slits formed therein at a pitch of 150 to 300 lpi. A conveying roller encoder sensor 363 is fixed in the shown position in the chassis 11 so as to detect how many times and when the slits in the code wheel 362 pass through the encoder sensor 363.

The pulley gear 361 includes a pulley portion and a gear portion. The drive of the gear portion is transmitted through an idler gear 45 to a discharge roller gear 404, and the discharge roller 40 is thereby driven. A discharge code wheel 402 is provided on the axis of the discharge roller 40. The discharge code wheel 402 is provided with a discharge roller encoder 403 that serves as a position detection unit for detecting the amount of conveyance by the discharge roller 40.

In this embodiment, the rotation ratio between the conveying roller 36 and the discharge roller 40 is 1:1. The rotation ratio between the conveying roller 36 and each of the conveying roller gear 361, the idler gear 45, and the discharge roller gear 404, which constitute a drive transmitting unit to the discharge roller 40, is also 1:1. Due to this configuration, the rotation period of the conveying roller 36 is equal to the rotation period of the discharge roller 40 and the transmission gears. The conveyance amount error attributed to the roller eccentricity arises with the same period as the roller rotation.

Reference is again made to FIG. 1. The roller pair of the conveying roller 36 and the pinch roller 37 is rotated by the conveying roller 35, and the recording medium nipped by the roller pair is conveyed in the apparatus. The pinch roller holder 30 is provided with an edge sensor for detecting and positioning the leading edge or the trailing edge of the recording medium. Due to the detection of the edge sensor, the recording medium is positioned on a platen 34 that is attached to the chassis 11 and located in a recording section.

(C) Carriage Section

The recording medium is supported from below by the platen 34 downstream of the conveying roller 36. A carriage 50 passes over the recording medium. A print head 7 mounted on the carriage 50 forms an image on the recording medium on the basis of recording image information.

The carriage 50 supports a recording head 7 and an ink tank 71 for supplying ink to the recording head 7 and is movable in a scanning direction shown by an arrow X in FIG. 1 that is a direction perpendicular to the conveying direction. The recording head 7 of this embodiment applies a voltage pulse to a heater provided at a position corresponding to each ejection port, thereby generating film boiling. The pressure change due to expansion or contraction of a bubble ejects ink through each ejection port. However, the present invention is not limited to such a method for discharge.

The carriage 50 is supported and guided by a carriage rail 52 and an upper guide rail 111 extending in a direction perpendicular to the recording medium conveying direction. The carriage rail 52 is attached to the chassis 11. The upper guide rail 111 is integrated with the chassis 11. The upper guide rail 111 also plays a role in holding an edge of the carriage 50 and maintaining a clearance between the ejection port surface of the recording head 7 and the recording medium.

The carriage 50 is moved by the driving force of a carriage motor 54 attached to the chassis 11. The driving force of the carriage motor 54 is transmitted through an idle pulley 542 and a timing belt 541 supported by the idle pulley 542. A code strip 561 having markings formed therein at a pitch of 150 to 300 lpi is stretched parallel to the timing belt 541. An encoder sensor (not shown) mounted on the carriage 50 detects the markings while the carriage 50 moves. The present position of the carriage 50 can be thereby detected. A flexible cable 57 follows the reciprocation of the carriage 50 and electrically connects a carriage substrate on the carriage 50, on which the encoder sensor is provided, with an electric substrate 91 fixed in the apparatus. A recording signal for the recording head 7 to perform recording is transmitted from the electric substrate 91 through the flexible cable 57 and the carriage substrate. According to this recording signal, each heater of the recording head 7 in motion is driven, and dots are formed on the recording medium on the platen 34.

(D) Discharge Section

The discharge roller 40 is rotated by the rotating force of the conveying roller 36. The rotating force of the conveying roller 36 is transmitted through the gear portion of the pulley gear 361, which is directly connected to the conveying roller 36, and the idler gear 45 to the discharge roller gear 404, which is directly connected to the discharge roller 40. Reference is again made to FIG. 2. The discharge code wheel 402 is provided on the axis of the discharge roller 40, and the discharge roller encoder 403 detects the amount of rotation of the discharge roller 40.

A spur holder 43 holds a plurality of spurs. These spurs are pressed against the discharge roller 40 by a spur spring that is a rod-shaped coil spring. The recording medium on which an image is formed by the recording head 7 is nipped between the discharge roller 40 and these spurs, conveyed, and discharged.

The discharge section may include two rollers. In this case, the recording medium conveyance accuracy can be improved.

Figure 9:
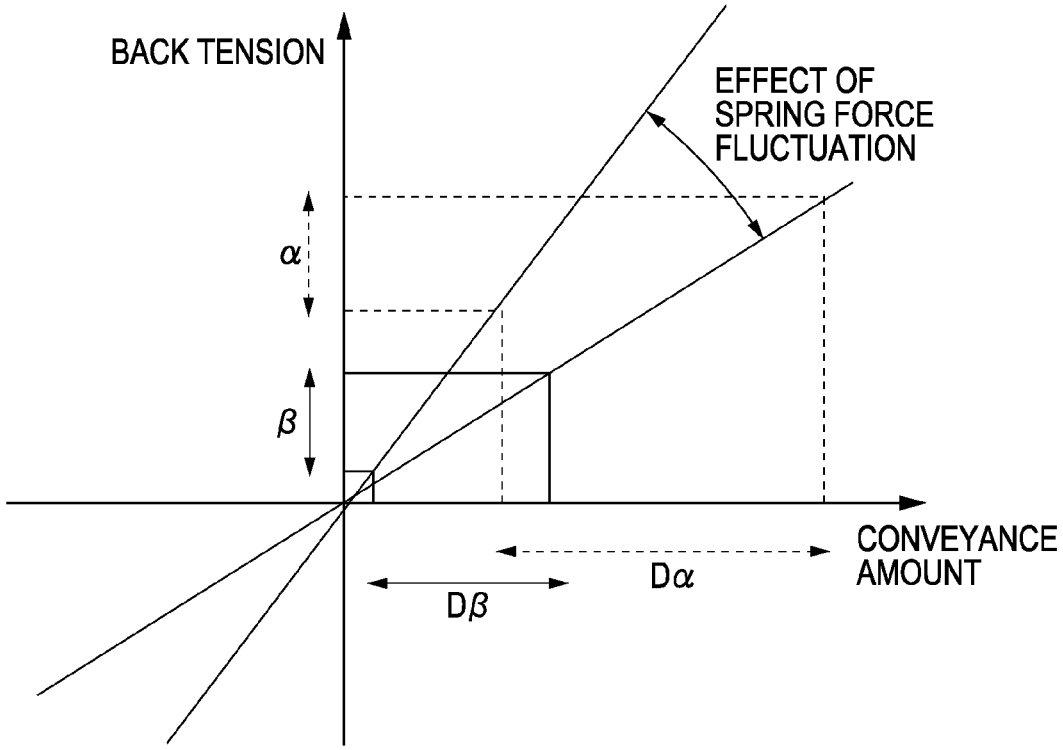
FIG. 9 is an electric block diagram of a recording apparatus applicable to the embodiment of the present invention.

FIG. 9 is a diagram for illustrating that the relationship between conveyance load (hereinafter also referred to as back tension) and conveyance amount fluctuates depending on the pressing force of the spring exerted on the discharge roller 40. The two straight lines in FIG. 9 show the relationships between conveyance load and back tension under different pressing forces.

Comparison of the two straight lines shows that when the same amount of back tension variations are caused by component tolerance or variation in stiffness among recording media, the variation in conveyance amount in the case where the absolute value of back tension is small is smaller than that in the case where the absolute value of back tension is large.

Figure 10A:
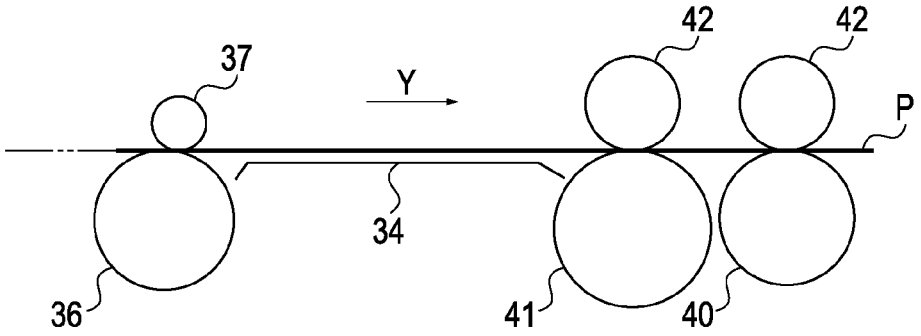
FIGS. 10A and 10B are diagrams for illustrating another example configuration of a discharge section of the embodiment.
Figure 10B:
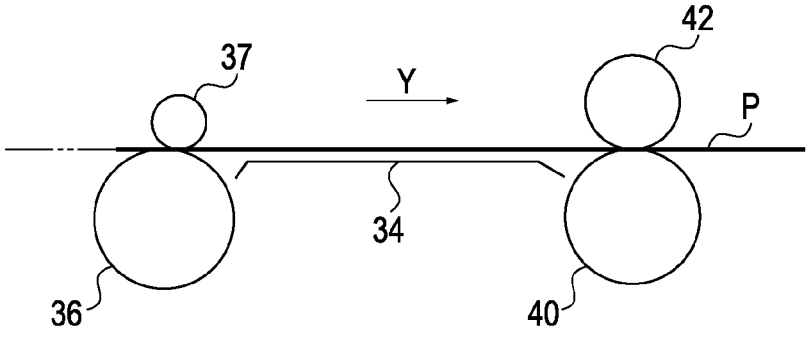

FIGS. 10A and 10B are diagrams for illustrating the configuration of a discharge section in which a discharge assist roller (third conveying roller) is provided in addition to a discharge roller (second conveying roller) to minimize the above-described variation in conveyance amount. The discharge assist roller 41 plays a role in cancelling the back tension acting on the discharge roller 40. The discharge assist roller 41 is provided upstream of the discharge roller 40 in the conveying direction. To cancel the back tension acting on the discharge roller 40, the roller peripheral speed of the discharge assist roller 41 is set higher than that of the discharge roller 40 downstream thereof. That is to say, when the rotation ratio between the discharge roller 40 and the discharge assist roller 41 is 1:1, the diameter of the discharge assist roller 41 is larger than that of the discharge roller 40. Thus, the discharge assist roller 41 serves as an accelerating system. This reduces the back tension acting on the discharge roller 40, and the roller configuration is insusceptible to the spring pressure of the spurs and back tension.

Whereas the discharge roller 40 is formed of rubber, the discharge assist roller 41 is formed of plastic, which has a low coefficient of friction, to reduce the disturbance of the discharge roller 40 due to the conveying power of the discharge assist roller 41. In addition, the discharge assist roller 41 also plays a role in preventing the recording medium from loosening in the recording head portion.

Hereinafter, for the sake of simplicity, the discharge assist roller 41 will be omitted. The discharge section in the following description has a single discharge roller 40.

(E) Cleaning Section

Reference is again made to FIG. 1. A cleaning section 60 includes a pump that cleans the recording head 7, a cap for reducing drying of the recording head 7, and a blade that cleans the ejection port surface of the recording head 7. The primary force that drives the cleaning section 60 is transmitted from the paper feed motor 99 described above. The cleaning section 60 performs a suction operation and a blade operation. In the suction operation, the pump is operated with the cap in close contact with the recording head 7 so as to suck unnecessary ink out of the recording head 7. In the blade operation, the blade is moved so as to clean the ejection port surface of the recording head 7.

Figure 4:
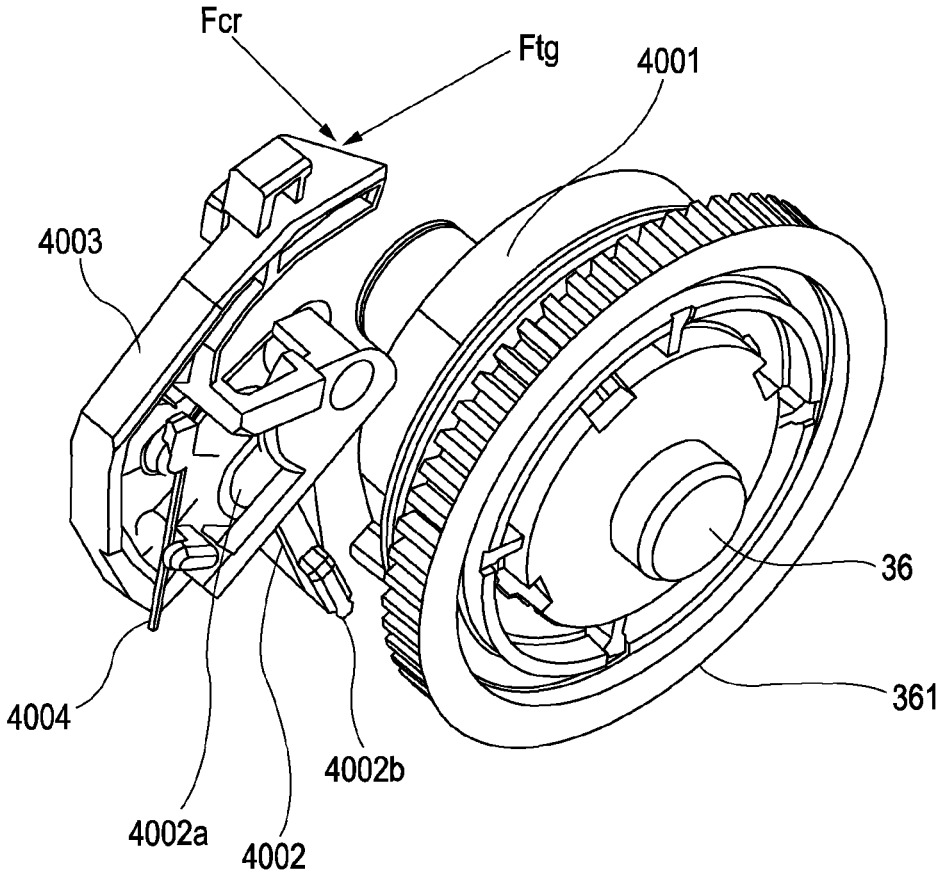
FIG. 4 is a diagram for illustrating a mechanism that detects the origin in a conveying roller of an embodiment of the present invention.
Figure 5:
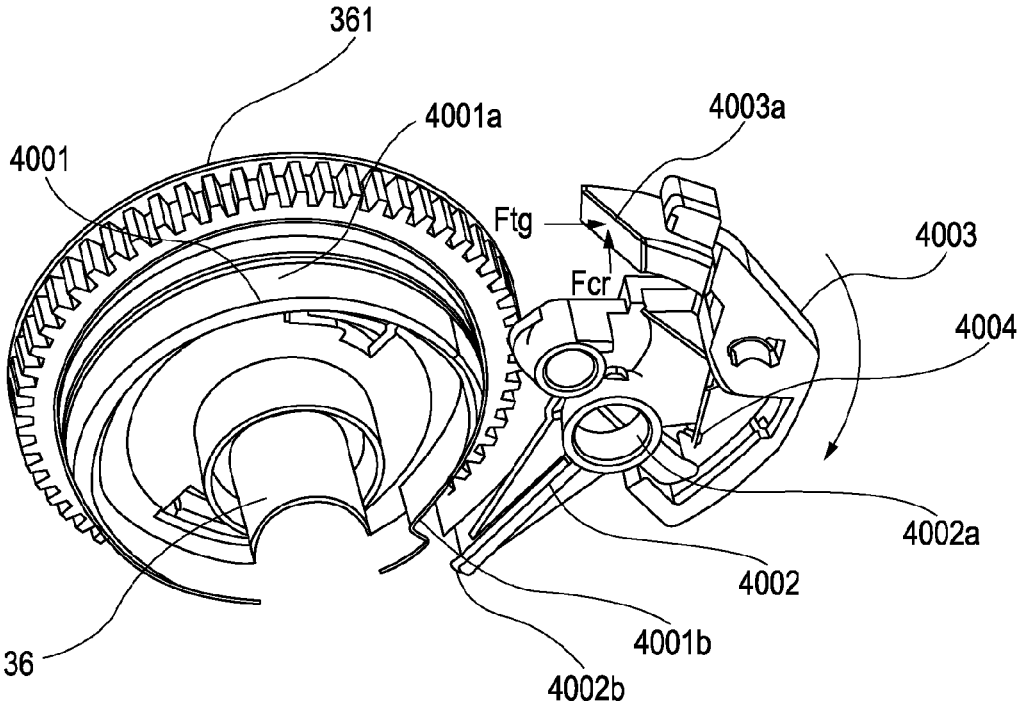
FIG. 5 is a diagram for illustrating a mechanism that detects the origin in a conveying roller of an embodiment of the present invention.

FIGS. 4 and 5 are diagrams for illustrating a mechanism that detects the origin in the conveying roller (first conveying roller) of this embodiment. FIG. 4 is a perspective view as viewed from the outer side of the pulley gear 361 on the conveying roller 36. FIG. 5 is a perspective view as viewed from the inner side of the pulley gear 361 on the conveying roller 36. A lock ring 4001 is attached to the pulley gear 361, has a circumferential portion 4001*a* and a depressed portion 4001*b*, and rotates integrally with the conveying roller 36. A lock lever 4002 rotates around the center 4002*a* of rotation and fits a lock portion 4002*b* into the depressed portion 4001*b* of the lock ring 4001, thereby locking the lock ring 4001. A lock link lever 4003 is a lever that presses down and pulls up the lock lever 4002. The force that makes the lock link lever 4003 press down and pull up the lock lever 4002 is generated by a lock lever spring 4004. The force Ftg that rotates the lock link lever 4003 is generated by the movement of the carriage 50 to a lock position (on the left side of FIG. 1) located on the side opposite to the home position and outside the recording scanning region.

Figure 6:
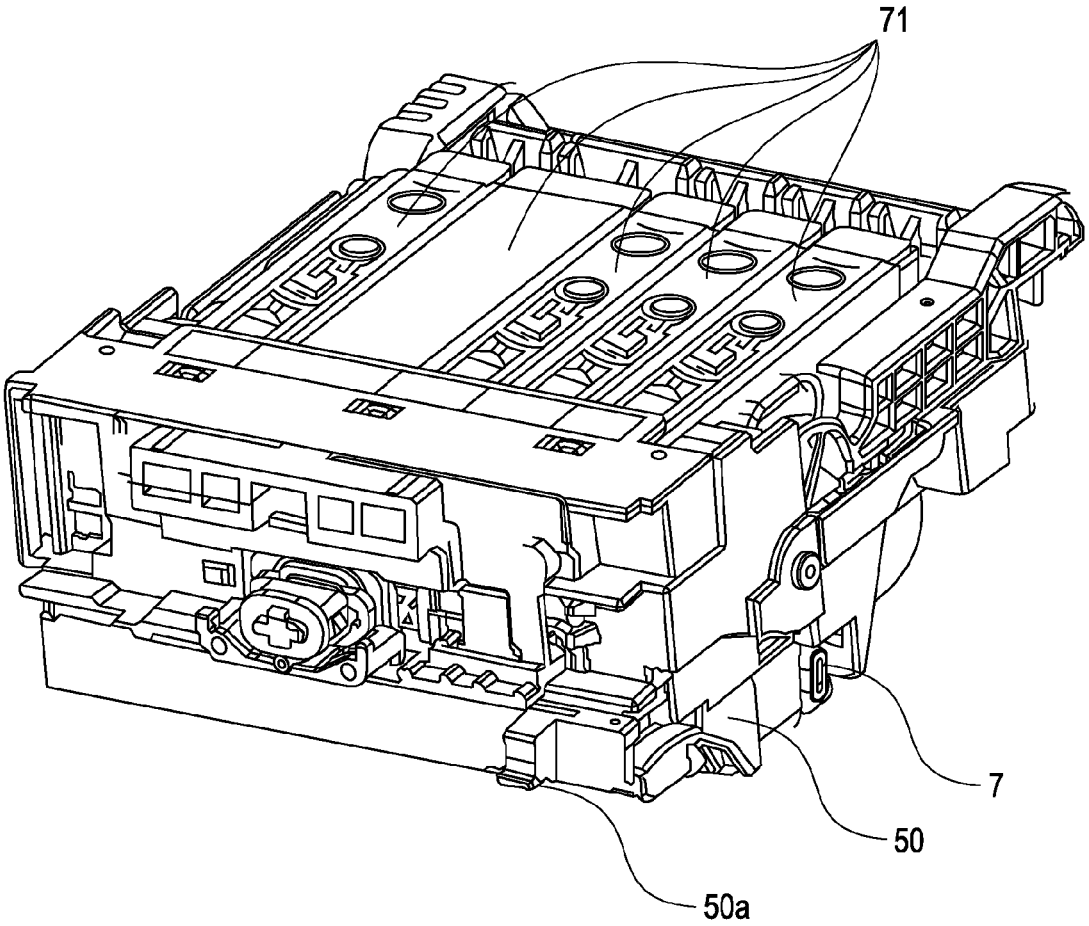
FIG. 6 is a rear perspective view of a carriage in a recording apparatus of the embodiment.

FIG. 6 is a rear perspective view of the carriage 50 in the recording apparatus of this embodiment. A protrusion 50*a* is attached to the rear surface of the carriage 50. When the carriage 50 reaches the lock position, the protrusion 50*a* comes into contact with an inclined surface 4003*a* of the lock link lever 4003. Due to this contact, a predetermined force Fcr acts on the inclined surface 4003*a* of the lock link lever 4003. Reference is again made to FIG. 4 or 5. The force Ftg that rotates the lock link lever 4003 in the direction of the arrow in FIG. 5 is generated.

Figure 7A:
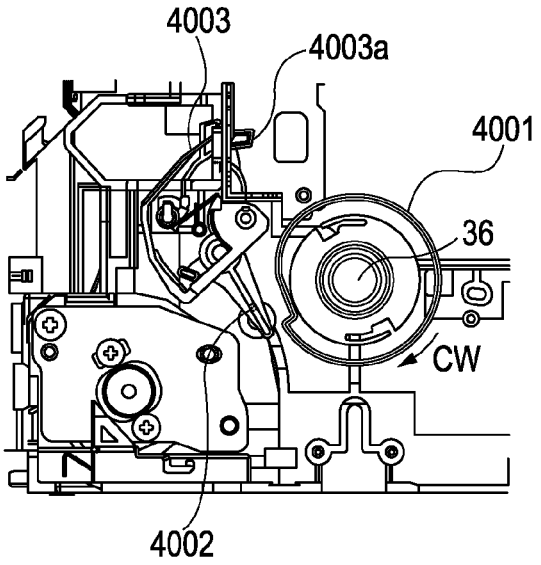
FIGS. 7A to 7C are sectional views for specifically illustrating a process through which the lock mechanism described in FIGS. 4 to 6 functions.
Figure 7B:
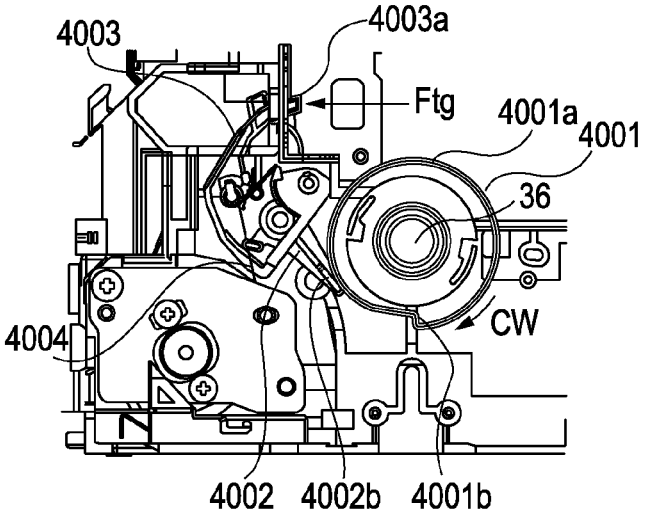
Figure 7C:
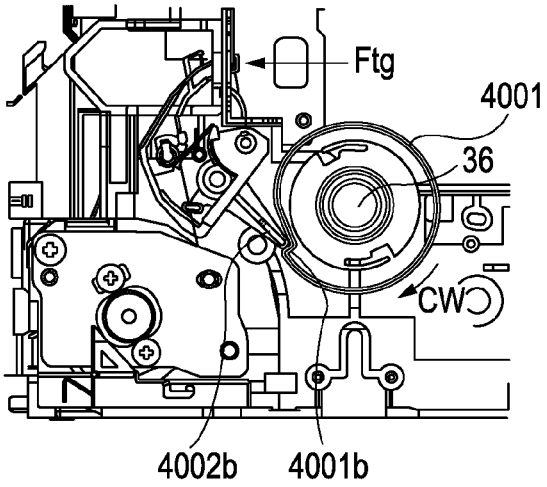

FIGS. 7A to 7C are sectional views for specifically illustrating a process through which the lock mechanism described in FIGS. 4 to 6 functions.

FIG. 7A is a diagram showing a state where the carriage 50 is not at the lock position. In this state, the lock link lever 4003 is not pressed, and therefore the lock ring 4001 is out of contact with the lock lever 4002. During a recording operation, the conveying roller 36 and the lock ring 4001 rotate intermittently in the direction CW to convey a recording medium.

FIG. 7B shows a state where the carriage 50 is at the lock position, the lock link lever 4003 is pressed by the protrusion 50*a*, and the mechanism is triggered. Due to the generation of the force Ftg, the lock link lever 4003 rotates. The pressing force of the lock lever spring 4004 brings the lock lever 4002 into contact with the circumferential portion 4001*a* of the lock ring 4001. Although the lock lever 4002 is pressed by the circumferential portion 4001*a* of the lock ring 4001, the lock lever 4002 can perform a stroke in the lock link lever 4003. Therefore, the collision between the protrusion 50*a* of the carriage 50 and the lock link lever 4003 causes no damage. Since the lock lever 4002 and the lock link lever 4003 are two separate components, the amount of stroke of the lock lever 4002 and the amount of swing of the lock link lever 4003 can be set independently of each other.

FIG. 7C is a diagram showing a state where the rotation of the conveying roller 36 is locked by the lock ring 4001 after the conveying roller 36 is further rotated from the state of FIG. 7B. With the lock lever 4002 in contact with the circumferential portion 4001*a* of the lock ring 4001, the lock ring 4001 further rotates in the direction WC. The lock portion 4002*b* of the lock lever 4002 fits into the depressed portion 4001*b* of the lock ring 4001 and prevents the lock ring 4001 from further rotating in the direction CW. That is to say, the lock ring 4001 and the conveying roller 36 are locked. Since the lock ring 4001 is fixed to the pulley gear 361, which transmits power from the conveying motor 35, rotating force is not generated between the conveying roller 36 and the pulley gear 361.

The conveying roller 36 is locked only at a predetermined rotational position. Such a position at which the conveying roller 36 is locked can serve as the origin of the phase of the conveying roller 36.

The origin of the phase of the conveying roller 36 may be detected by a known method. For example, an edge of one cycle per revolution printed on a code wheel may be detected with a sensor, or an edge of one cycle per revolution attached to a roller may be detected with a sensor.

Figure 8:
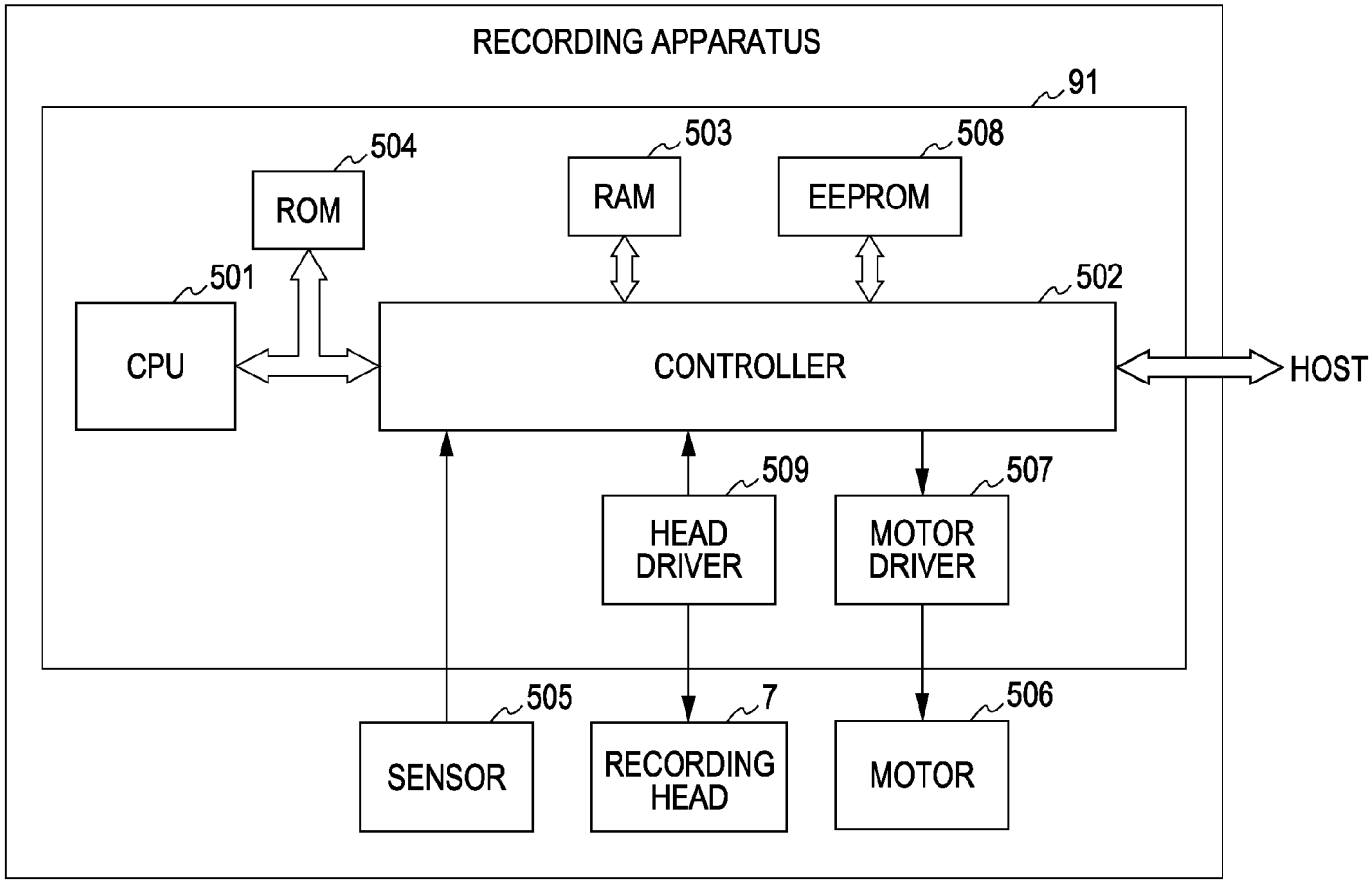
FIG. 8 is an electric block diagram in the recording apparatus of the embodiment.

FIG. 8 is a block diagram for illustrating the control of the recording apparatus of this embodiment. A CPU 501 controls each mechanism in the apparatus through a controller 502 in accordance with various programs stored in a ROM 504. A RAM 503 is used as a work area for temporarily storing various data and performing processing. The CPU 501 converts image data received from an external host device into a recording signal that the recording apparatus can record. Various motors 506 are driven through motor drivers 507, and the recording head 7 is driven through a recording head driver 509, so as to form an image on a recording medium. In FIG. 8, the motor 506 includes the conveying motor 35, the carriage motor 54, and the paper feed motor 99 described above, and the motor driver 507 includes drivers for the respective motors.

An EEPROM 508, which is electrically writable, stores factory default values and update. The data are used as control parameters by the controller 502 and the CPU 501. The sensor 505 includes temperature sensors and encoder sensors installed in various parts of the apparatus. The above-described conveying roller encoder sensor 363 is one of them. The CPU 501 increments count information each time the conveying roller encoder sensor 363 detects a slit, in a ring buffer of the RAM 503. When the origin is detected, the origin information is stored in another area in the RAM 503 or the EEPROM.

Features of this embodiment will be described in detail.

Figure 11A:
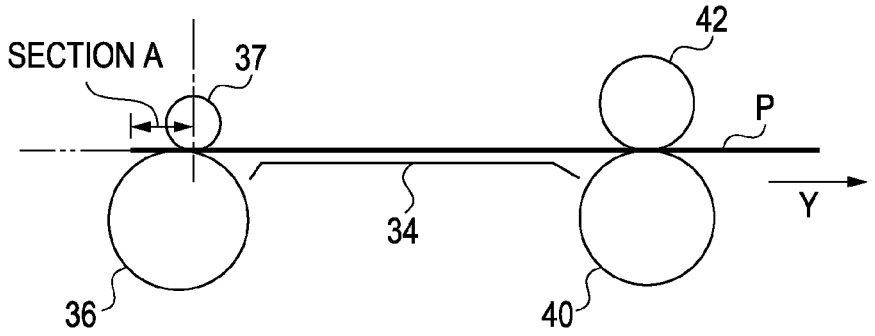
FIGS. 11A to 11C are diagrams for illustrating the conveyance amount at the time of transfer in the embodiment.
Figure 11B:
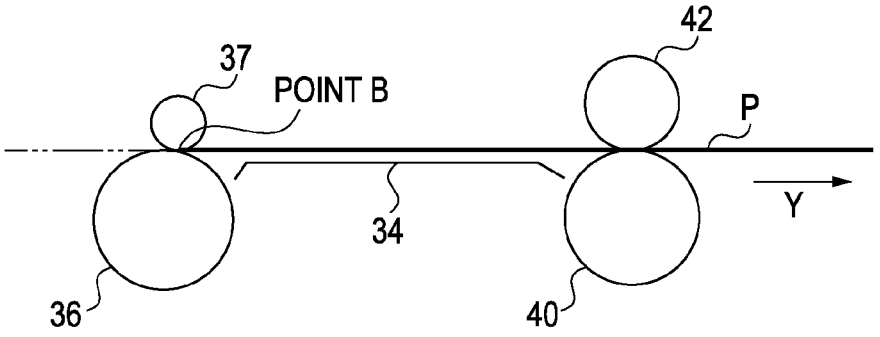
Figure 11C:
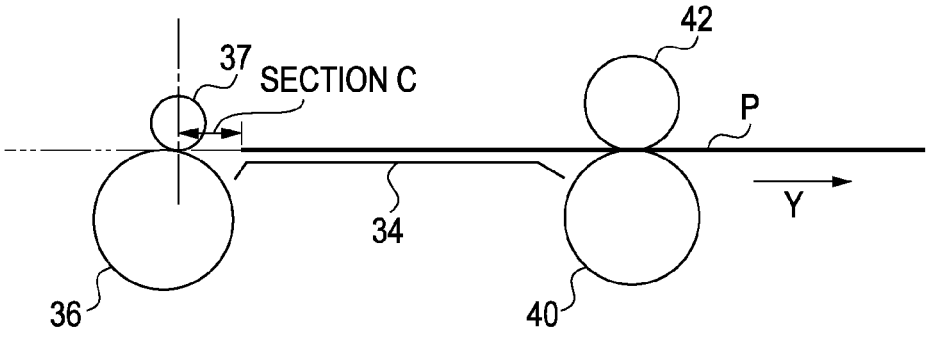

First, a description will be given of a phenomenon in which the conveyance amount error fluctuates at the time of transfer from the conveying roller 36 to the discharge roller 40. FIGS. 11A to 11C are diagrams for illustrating the conveyance amount at the time of transfer from the conveying roller 36 to the discharge roller 40.

The neighborhood of the nip between the conveying roller 36 and the pinch roller 37 shown in FIG. 11A is an unstable section unsuitable for stopping paper. Therefore, in the conveying operation at the time of transfer, conveyance needs to be controlled so as not to stop paper in this section. That is to say, when paper passes through the nip of the conveying roller 36, conveyance is started upstream of the nip shown in FIG. 11B, and conveyance is stopped downstream of the nip shown in FIG. 11C. The conveying position in this conveying operation is separated into a section A, a point B, and a section C. When the trailing edge of paper is in the section A, the paper is conveyed by both the conveying roller 36 and the discharge roller 40. When the trailing edge of paper is at the point B, the paper has just passed through the nip. When the trailing edge of paper is in the section C, the paper is conveyed only by the discharge roller 40.

There is roller eccentricity in the conveying roller 36 and the discharge roller 40. Therefore, in each of the rollers, the conveyance amount per given angle of rotation fluctuates depending on the rotation phase of the roller. In the regions where the conveyance amount is large, the conveyance amount per given angle of rotation is larger than a predetermined amount, and therefore the paper conveying speed is higher than a predetermined speed. In contrast, in the regions where the conveyance amount is small, the conveying speed is low. The fluctuation in conveying speed due to roller eccentricity in each of the conveying roller 36 and the discharge roller 40 causes a difference in conveying speed between the conveying roller 36 and the discharge roller 40.

The difference in conveying speed between the conveying roller 36 and the discharge roller 40 causes fluctuation in conveyance amount when the trailing edge of paper moves from the section A to the section C. When paper is conveyed by both the conveying roller 36 and the discharge roller 40, the difference in conveying speed between the two rollers generates attraction force or repulsion force acting between the conveying roller 36 and the discharge roller 40 via the paper. When the trailing edge of paper passes through the point B, the discharge roller 40 is released from the deflection due to this force. Thus, an amount of conveyance arises from a peculiar factor, the difference in conveying speed between the conveying roller 36 and the discharge roller 40.

Of course, in the section A and the section C, roller eccentricity causes conveyance amount errors. In the section A, the conveyance amount control by the conveying roller 36 is dominant, and therefore the eccentricity of the conveying roller 36 causes a conveyance amount error. In the section C, the eccentricity of the discharge roller 40 causes a conveyance amount error. Therefore, (the integral of) unit conveyance amount error in the section A and (the integral of) unit conveyance amount error in the section C also need to be taken into account in correcting the conveyance amount.

In this way, the conveyance amount error fluctuates at the time of transfer from the conveying roller 36 to the discharge roller 40, depending on the rotation phase of the conveying roller 36 and the discharge roller 40 in the conveying operation at the time of transfer. Therefore, when correcting the conveyance amount at the time of transfer from the conveying roller 36 to the discharge roller 40, it is important to minimize the difference in unit conveyance amount (conveying speed) between the section A and the section C, in addition to correcting the conveyance amount errors due to eccentricity in the section A and the section C. In the state where paper is conveyed by both the conveying roller 36 and the discharge roller 40 (section A), the conveyance amount control by the conveying roller 36 is dominant, and therefore this state can be regarded simply as a state where paper is conveyed by the conveying roller 36.

Next, with reference to FIGS. 12, 13A to 13C, and 14A to 14C, a description will be given of the recording medium (paper) P conveyance amount error caused by the difference in conveying speed between the conveying roller 36 and the discharge roller 40 at the time of transfer.

Figure 12:
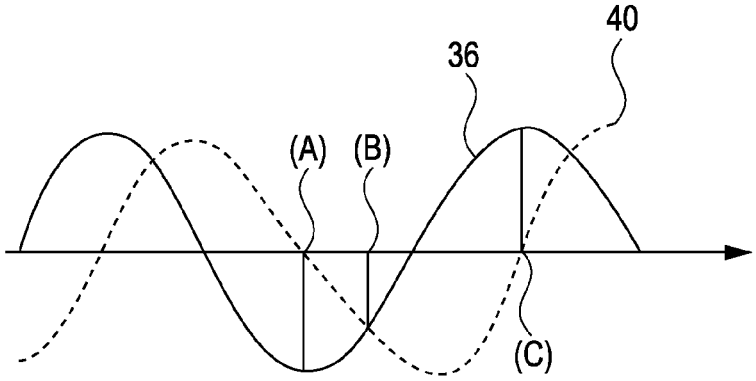
FIG. 12 is a diagram for illustrating the conveyance amount error in each rotation phase of the conveying roller and the discharge roller in the embodiment.

In FIG. 12, the vertical axis shows conveyance amount error, and the horizontal axis shows roller rotation phase. In FIG. 12, the fluctuation in conveyance amount depending on roller rotation phase in a state where a recording medium P is conveyed by both the conveying roller 36 and the discharge roller 40 (section A) is shown by a full line, and the fluctuation in conveyance amount depending on roller rotation phase in a state where the recording medium P is conveyed only by the discharge roller 40 (section C) is shown by a dashed line. In FIG. 12, the area above the center 0 of the vertical axis shows a state where the roller conveying speed is higher than a predetermined speed, the recording medium conveyance amount is larger than a predetermined conveyance amount, and the conveyance amount error is positive. The area below the center 0 of the vertical axis shows a state where the roller conveying speed is lower than the predetermined speed, the recording medium conveyance amount is smaller than the predetermined conveyance amount, and the conveyance amount error is negative.

Figure 13A:
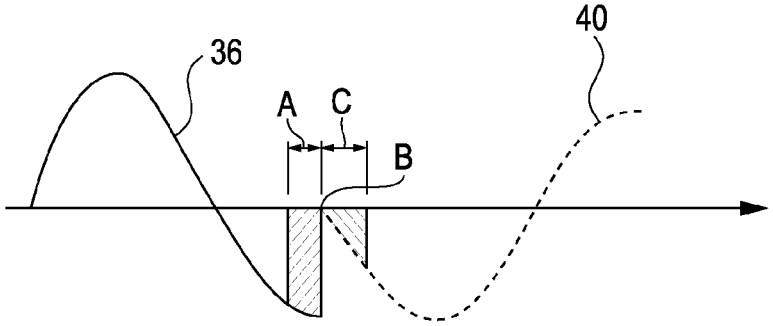
FIGS. 13A, 13B, and 13C show the conveyance amount errors in the section A and the section C when paper is transferred in the rotation phases of FIG. 12.
Figure 13B:
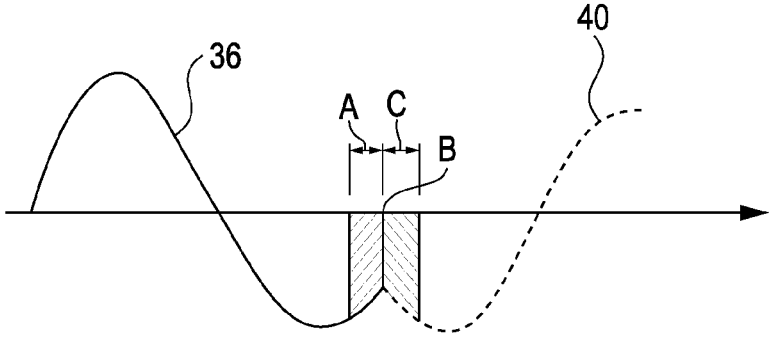
Figure 13C:
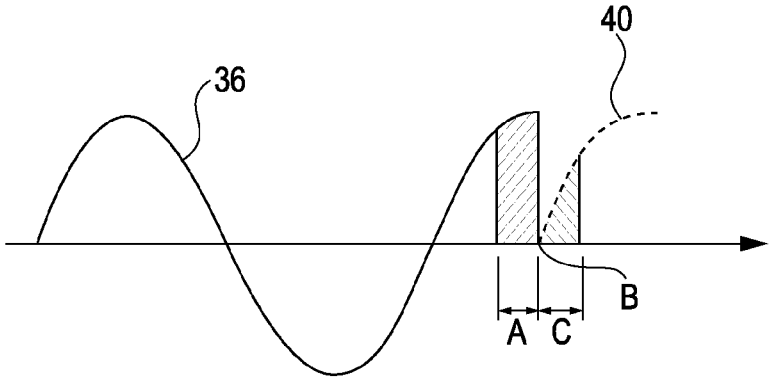
Figure 14A:
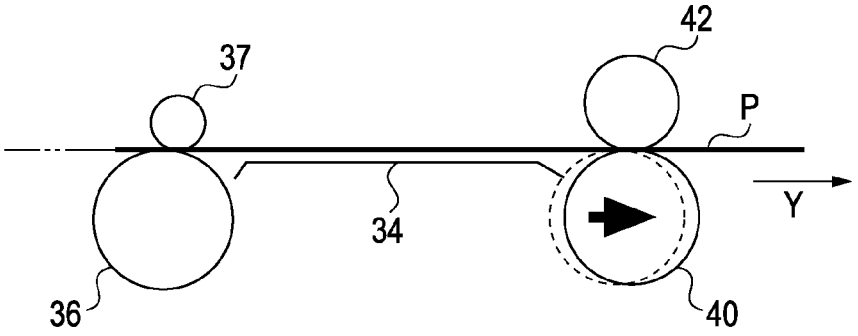
FIGS. 14A, 14B, and 14C show the deflection of the discharge roller in the states of FIGS. 13A, 13B, and 13C, respectively.
Figure 14B:
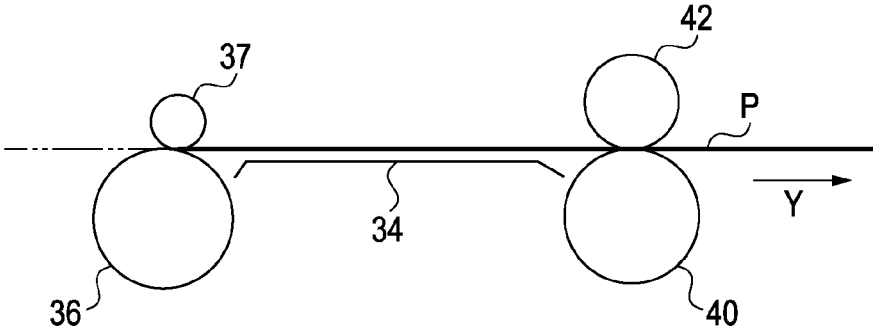
Figure 14C:
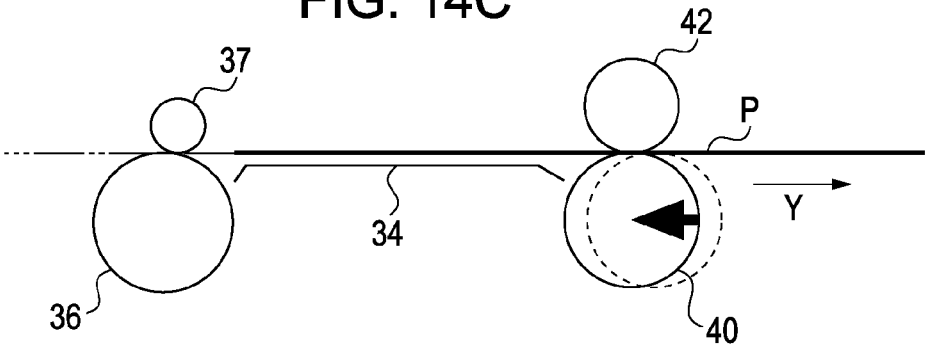

FIGS. 13A, 13B, and 13C show the conveyance amount errors of the section A and the section C when paper is transferred from the conveying roller 36 to the discharge roller 40 in the rotation phases (A), (B), and (C), respectively, of FIG. 12. FIGS. 14A, 14B, and 14C correspond to FIGS. 13A, 13B, and 13C, respectively, and show the deflection of the discharge roller 40.

FIG. 13A shows the conveyance amount errors of the section A and the section C when paper is transferred in the rotation phase (A) of FIG. 12. In this phase, the conveyance amount error of the conveying roller 36 is smaller than the conveyance amount error of the discharge roller 40, that is to say, the conveying speed of the conveying roller 36 is lower than the conveying speed of the discharge roller 40. Therefore, the discharge roller 40 serves as an accelerating system compared to the conveying roller 36. Therefore, as shown in FIG. 14A, the discharge roller 40 deflected upstream by the traction force (friction force) between the discharge roller 40 and the recording medium P is released as soon as the trailing edge of the recording medium P has passed through the nip of the conveying roller 36, and the discharge roller 40 moves downstream. Due to this movement of the discharge roller 40, the paper conveyance amount at the time of transfer increases. The sum of this increase in conveyance amount and the integral of conveyance amount error in the section A and the integral of conveyance amount error in the section C shown in FIG. 13A corresponds to the conveyance amount error at the time of transfer.

FIG. 13B shows the conveyance amount errors of the section A and the section C when paper is transferred in the rotation phase (B) of FIG. 12. In this phase, the conveyance amount error of the conveying roller 36 is equal to the conveyance amount error of the discharge roller 40, that is to say, the conveying speed of the conveying roller 36 is equal to the conveying speed of the discharge roller 40. Therefore, the discharge roller 40 serves as a constant speed system. As shown in FIG. 14B, a force generated by the difference in speed between the conveying roller 36 and the discharge roller 40 and acting through the recording medium is not generated. Therefore, when the trailing edge of the recording medium P has passed through the nip of the conveying roller 36, the movement of the discharge roller 40 due to the release of the discharge roller 40 from deflection cannot occur. Therefore, the recording medium P conveyance amount does not vary due to the movement of the discharge roller 40. Therefore, the sum of the integral of conveyance amount error in the section A and the integral of conveyance amount error in the section C shown in FIG. 13B substantially corresponds to the conveyance amount error at the time of transfer.

FIG. 13C shows the conveyance amount errors of the section A and the section C when paper is transferred in the rotation phase (C) of FIG. 12. In this phase, the conveyance amount error of the conveying roller 36 is larger than the conveyance amount error of the discharge roller 40, that is to say, the conveying speed of the conveying roller 36 is higher than the conveying speed of the discharge roller 40. Therefore, the discharge roller 40 serves as a decelerating system compared to the conveying roller 36. Therefore, as shown in FIG. 14C, the discharge roller 40 deflected downstream by the traction force (friction force) between the discharge roller 40 and the recording medium P is released as soon as the trailing edge of the recording medium P has passed through the nip of the conveying roller 36, and the discharge roller 40 moves upstream. Due to this movement of the discharge roller 40, the paper conveyance amount at the time of transfer decreases. The sum of this decrease in conveyance amount and the integral of conveyance amount error in the section A and the integral of conveyance amount error in the section C shown in FIG. 13C corresponds to the conveyance amount error at the time of transfer.

Next, a description will be given of a method for correcting and controlling the conveyance amount in the conveying operation at the time of transfer. The general procedure for correcting and controlling the conveyance amount in the conveying operation at the time of transfer will be described. First, paper is conveyed with the roller rotation phase controlled, and the paper conveyance amount in each rotation phase section is measured, in each of the section A and the section B. Next, from the measurement, the conveyance amount correction value of each rotation phase section in the section A (conveying roller 36) and the section C (discharge roller 40) is calculated. Then, in the actual recording operation, according to the rotation phase at the time of transfer, a correction value for correcting the conveyance amount in the conveying operation at the time of transfer is calculated from the conveyance amount correction values of each rotation phase section of the conveying roller 36 and the discharge roller 40, and the conveyance amount of the conveying operation at the time of transfer is corrected.

Figure 22:
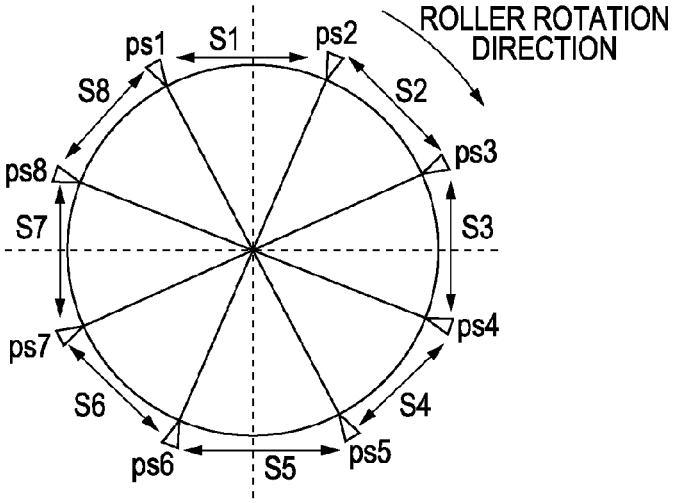
FIG. 22 is a diagram illustrating a correction value table that stores the correction value of each rotation phase section of the conveying roller and the discharge roller.

FIG. 22 shows a conceptual diagram of eight rotation phase sections S1 to S8 formed by dividing the roller periphery into eight, and a correction value table storing the conveyance amount correction value of each rotation phase section. In FIG. 22, positions ps1 to ps8 show roller rotation phase positions at which conveyance of paper is started in one conveying operation. In this embodiment, the roller periphery of each of the conveying roller 36 and the discharge roller 40 is divided into eight, and conveyance amount correction is controlled by the eight rotation phase sections S1 to S8. In addition, in this embodiment, the rotation phase ratio between the conveying roller 36 and the discharge roller 40 is 1:1, and therefore the roller rotation phases of both rollers are managed by the same angle.

Figure 18:
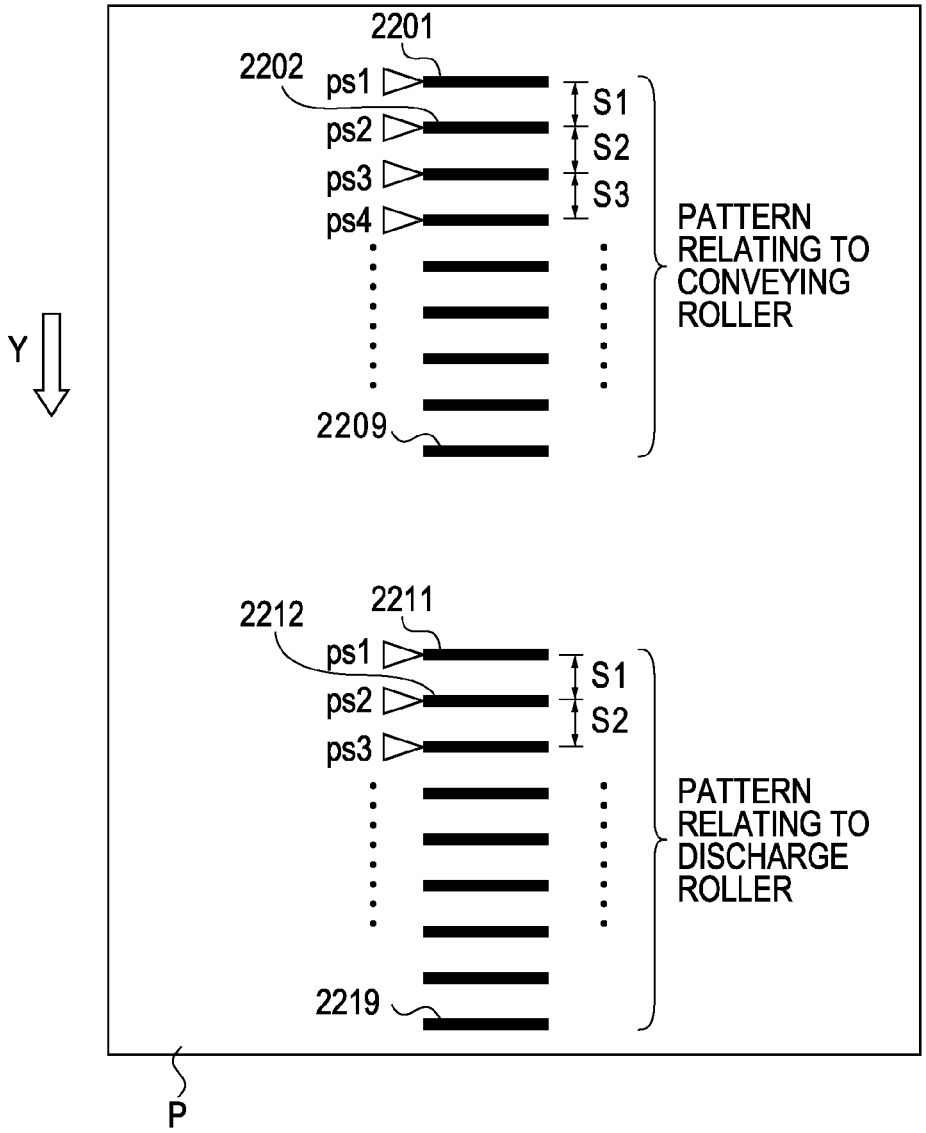
FIG. 18 shows a test pattern for obtaining the correction value of each rotation phase section of the conveying roller and the discharge roller.

FIG. 18 shows an example of a test pattern recorded for obtaining the conveyance amount correction value of each rotation phase section of the conveying roller 36 and the discharge roller 40.

First, with reference to FIGS. 22 and 18, a description will be given of a method for obtaining the conveyance amount correction value of each rotation phase section of the conveying roller 36 and the discharge roller 40.

First, the origin of roller rotation phase is detected as described above, the origin of roller phase is thereby determined, and the roller rotation phase is made controllable. In a state where the roller rotation phase is controllable, a test pattern such as that shown in FIG. 18 is recorded.

When recording this test pattern, paper is first fed from the paper feed section and is conveyed until the rotation phase of the conveying roller 36 reaches the position ps1. After the rotation phase of the conveying roller 36 has reached the position ps1, a first line 2201 is recorded. After the first line 2201 is recorded, conveyance of paper is started from the position ps1. The paper is conveyed until the rotation phase of the conveying roller 36 reaches the position ps2, and then a second line 2202 is recorded. The distance between the first line 2201 and the second line 2202 corresponds to the unit conveyance amount in the rotation phase section S1 between the position ps1 and the position ps2. Similarly, after the second line 2202 is recorded, conveyance of paper is started from the position ps2. The paper is conveyed until the rotation phase of the conveying roller 36 reaches the position ps3, and then a third line 2203 is recorded.

The above operation is repeatedly performed until the rotation phase of the conveying roller 36 returns to the position ps1. In the case of this embodiment, by repeatedly performing the operation, nine lines 2201 to 2209 are recorded.

Next, to record the test pattern when the paper is conveyed only by the discharge roller 40, the paper is conveyed until the trailing edge of the paper has passed through the nip of the conveying roller 36 and the rotation phase of the discharge roller 40 has reached the position ps1. After the rotation phase of the discharge roller 40 has reached the position ps1, a first line 2211 is recorded. Next, conveyance of paper is started from the position ps1. The paper is conveyed until the rotation phase of the discharge roller 40 reaches the position ps2, and then a second line 2212 is recorded. The above operation is repeatedly performed until the rotation phase of the discharge roller 40 returns to the position ps1. In this way, nine lines 2211 to 2219 are recorded.

After the test pattern is recorded, the distances between the lines 2201 to 2209 and 2211 to 2219 are measured using a scanner (optical sensor) mounted, for example, on the carriage 50.

The distances between the lines 2201 to 2209 correspond to the conveyance amounts of the rotation phase sections S1 to S8 of the conveying roller 36. The distances between the lines 2211 to 2219 correspond to the conveyance amounts of the rotation phase sections S1 to S8 of the discharge roller 40. Therefore, by measuring the distances between the lines 2201 to 2209, the conveyance amount errors of the rotation phase sections S1 to S8 of the conveying roller 36 can be obtained. Similarly, by measuring the distances between the lines 2211 to 2219, the conveyance amount errors of the rotation phase sections S1 to S8 of the discharge roller 40 can be obtained.

In this embodiment, nine lines are recorded in each of the section A and the section C, and the number of intervals between lines is eight, which is the same as the number of roller rotation phase sections controlled by the recording apparatus. However, for example, the number of intervals between lines may be larger than the number of roller rotation phase sections to improve the measurement accuracy, or the number of intervals between lines may be smaller than the number of roller rotation phase sections to reduce the measurement time. However, when the number of intervals between lines is different from the number of roller rotation phase sections, interpolation processing of measured values needs to be performed to calculate conveyance amount correction values.

Next, conveyance amount correction values are stored in correction value storage locations prepared for the rotation phase sections of each roller. Correction value is obtained by subtracting measured value from ideal roller conveyance amount. The obtained correction values are stored in SLF1 to SLF8 and SEJ1 to SEJ8 of the correction value table of FIG. 22.

Through the above series of operations, the conveyance amount correction value of each rotation phase section of each of the conveying roller 36 and the discharge roller 40 can be obtained.

Next, a description will be given of a method for calculating the conveyance amount correction value at the time of transfer from the conveying roller 36 to the discharge roller 40, from the correction value of each rotation phase section of each roller. As described above, when correcting the conveyance amount at the time of transfer from the conveying roller 36 to the discharge roller 40, it is necessary to take into account the effect of deflection due to the difference in conveying speed between the rollers, in addition to the conveyance amount errors in the section A and the section C. As described above, the roller conveying speed corresponds to the error in roller unit conveyance amount. Therefore, using arithmetic coefficients A and B calculated from the difference in conveyance amount correction value of each roller, the correction value at the time of transfer is calculated according to the following equation:

$$Sh=A\cdot SLF+B\cdot SEJ \qquad \text{Equation 1}$$

Sh: conveyance amount correction value in conveying operation at the time of transfer SLF: conveyance amount correction value of conveying roller 36 (first correction value)

SEJ: conveyance amount correction value of discharge roller 40 (second correction value)

Figure 15:
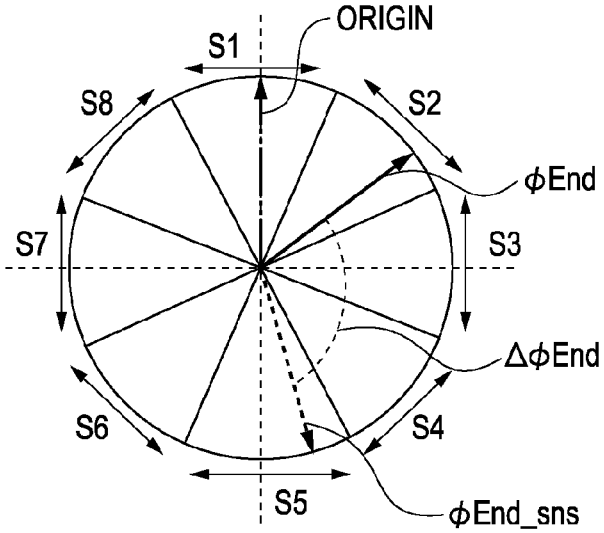
FIG. 15 is a diagram illustrating a correction table that stores the correction value of each rotation phase section in the embodiment.

That is to say, according to the above equation, correction values Sh1 to Sh8 at the time of transfer can be calculated taking into account the peculiar conveyance amount error due to the difference in conveying speed between the rollers, in addition to the conveyance amount errors in the section A (conveying roller 36) and the section C (discharge roller 40). The calculated correction values Sh1 to Sh8 at the time of transfer are stored in their respective locations in the correction value table shown in FIG. 15.

In relation to each of the conveying roller 36 and the discharge roller 40, correction values corresponding to eight rotation phase sections are obtained. Therefore, a maximum of 64 conveyance amount correction values at the time of transfer are calculated. However, since the rotation ratio between the conveying roller 36 and the discharge roller 40 is 1:1 in this embodiment, the eight values of the conveying roller 36 correspond one-to-one with the eight values of the discharge roller 40. Therefore, the correction values at the time of transfer are eight values of Sh1 to Sh8.

Figure 16A:
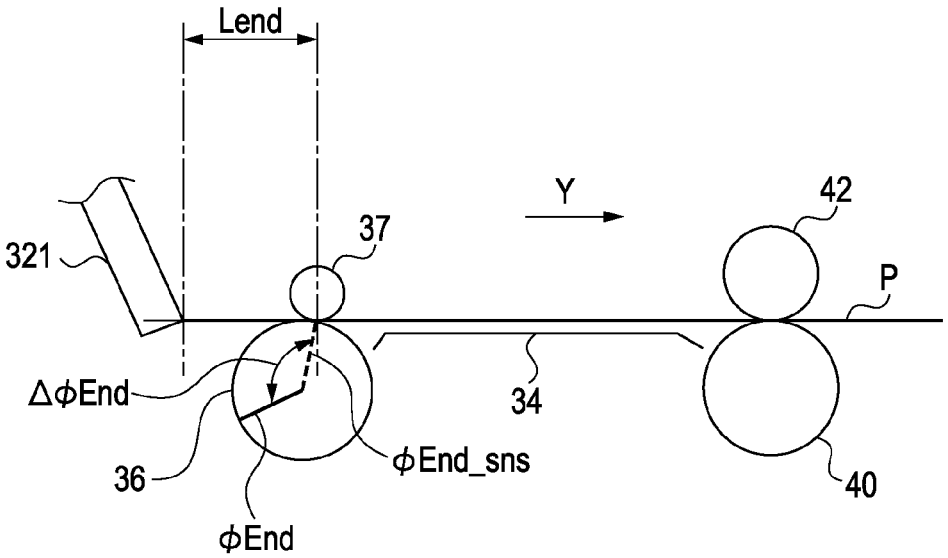
FIGS. 16A and 16B are diagrams illustrating a method for obtaining the roller rotation phase in the conveying operation at the time of transfer in the embodiment.
Figure 16B:
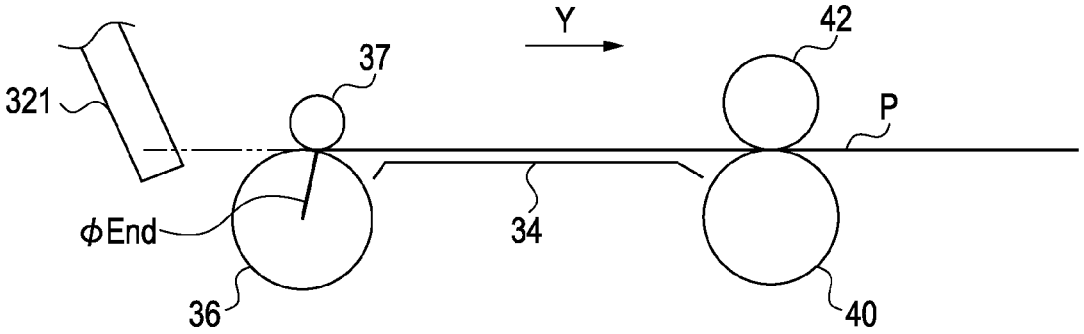

Next, with reference to FIGS. 16A, 16B and 17, a description will be given of the conveyance amount correction control at the time of transfer in the actual recording operation. FIGS. 16A and 16B are diagrams illustrating a method for obtaining the roller rotation phase in the conveying operation at the time of transfer.

FIG. 16A shows a state where a lever 321 provided upstream of the recording head 7 in the conveying direction detects the trailing edge of paper. In this state, the roller rotation phase is ϕEnd_sns. FIG. 16B shows a state where the trailing edge of paper has just passed through the nip of the conveying roller 36. In this state, the roller rotation phase is ϕEnd.

Figure 17:
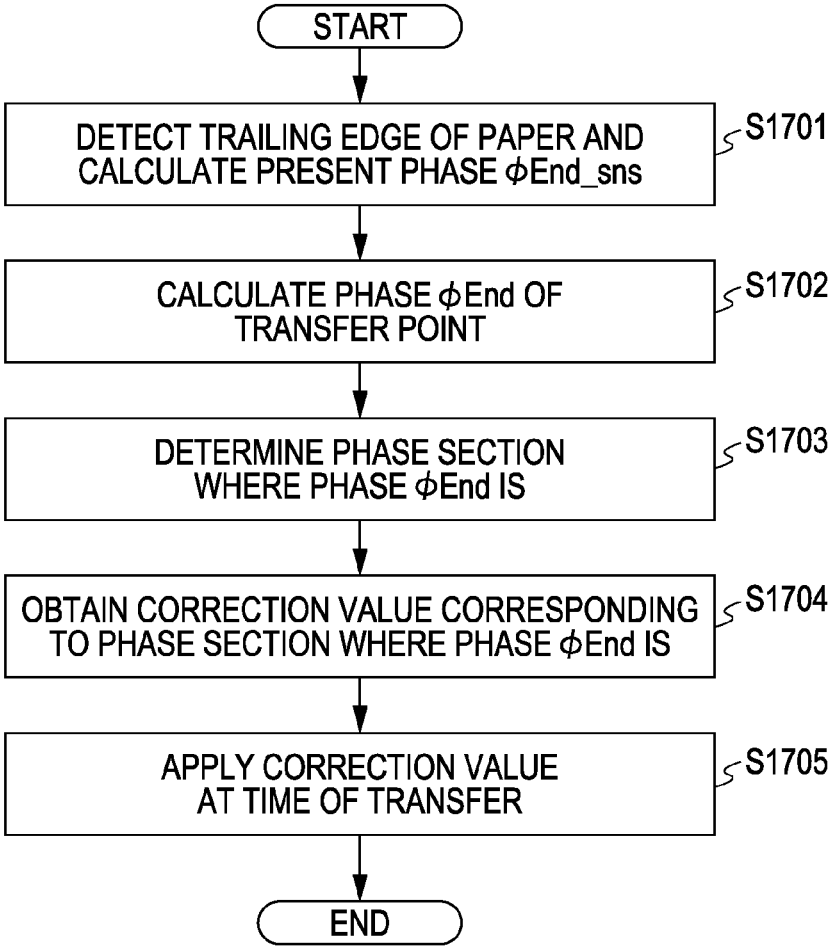
FIG. 17 shows a control flow of the conveyance amount correction at the time of transfer in the recording operation in a first conveyance amount control.

FIG. 17 shows a control flow of the conveyance amount correction at the time of transfer in the actual recording operation.

Reference is made to FIG. 17. At the start of the actual recording operation, in the step S1701, the trailing edge of paper is detected, and the roller rotation phase ϕEnd_sns at this time is obtained. As shown in FIG. 16A, at this time, the distance that the paper travels before the transfer (switching from the section A to the section C) is Lend. The roller rotation angle corresponding to the distance Lend is ΔϕEnd.

In the step S1701, a known method for detecting the trailing edge of paper is used. For example, the detection lever 321 (FIGS. 16A and 16B) is configured to leave a standby position when it comes into contact with the leading edge of paper being conveyed, and to return to the original position when the trailing edge of paper passes. By detecting the return of the detection lever 321 to the standby position, the trailing edge of paper can be detected.

Next, in the step S1702, the rotation phase ϕEnd at the time of transfer is calculated from the rotation phase ϕEnd_sns at the time of detection of the trailing edge of paper, and the distance Lend.

In the step S1703, it is determined in which rotation phase section the rotation phase ϕEnd exists. Hereinafter, a description will be given on the assumption that the rotation phase ϕEnd exists in the rotation phase section S2.

Next, in the step S1704, the conveyance amount correction value stored in the phase section at the time of transfer obtained in the step S1703 is obtained. In this example, the conveyance amount correction value Sh2 corresponding to the rotation phase section S2 is obtained. In the conveying operation at the time of transfer in the actual image recording operation, this correction value is applied to a predetermined conveyance amount (step S1705).

In the above description, the rotation phase section at the time of transfer is calculated with reference to the rotation phase ϕEnd_sns at the time of detection of the trailing edge of paper. However, the rotation phase section may always be calculated with reference to the phase origin ϕOrign. The rotation phase at the time of transfer may be estimated, without using the paper trailing edge detection information, from the recording medium length information and the print start position information.

In the above description, the conveyance amount correction values at the time of transfer are calculated in advance from the conveyance amount correction value of each rotation phase section of the conveying roller 36 and the discharge roller 40, and in the actual recording operation, an appropriate correction value is selected from a correction value table in which calculated correction values are stored. However, a correction value may be calculated during the actual recording operation, according to the rotation phase at the time of transfer, from the preliminarily-obtained conveyance amount correction value of each rotation phase section of the conveying roller 36 and the discharge roller 40.

The conveyance amount at the time of transfer from the conveying roller 36 to the discharge roller 40 varies depending on the conveyance amount error due to eccentricity in the section A and the section C, and the conveyance error caused by the difference in conveying speed between the conveying roller 36 and the discharge roller 40. That is to say, the above two conveyance amount errors are significantly affected by the unit conveyance amount (conveying speed) in the section A (conveying roller 36) and the section C (discharge roller 40). Therefore, when correcting the conveyance amount at the time of transfer, it is necessary to correct the conveyance amount on the basis of the relationship between the unit conveyance amounts (conveying speeds) in the section A (conveying roller 36) and the section C (discharge roller 40).

According to this embodiment, the conveyance amount at the time of transfer is corrected on a phase-by-phase basis, on the basis of the difference in unit conveyance amount (conveying speed) between the conveying roller 36 and the discharge roller 40. Therefore, paper can be conveyed with a higher degree of accuracy than in the case where a fixed correction value is applied.

In this embodiment, the rotation ratio between the conveying roller 36 and the transmitting gear is 1:1. However, the rotation ratio between the conveying roller 36 and the transmitting gear is not limited to 1:1. For example, the rotation of the idler gear 45 or the discharge roller 40 may be an integral multiple of the rotation of the conveying roller 36. Even if the rotation of the idler gear 45 or the discharge roller 40 may be an integral submultiple of the rotation of the conveying roller 36, the discharge roller 40 has a predetermined integral rotation periodicity of the conveying roller 36. For example, when the rotation of the conveying roller 36: the rotation of the discharge roller 40: the rotation of the idler gear 45=1: m: 1/n, the conveying roller 36 has a periodicity of m×n rotation. In this case, it goes without saying that the above-described conveyance amount correction can be performed by providing a unit that detects the rotation number information of the conveying roller 36, the rotation phase origin information of the idler gear 45, or the rotation phase origin information of the discharge roller 40.

Second Embodiment

In the first embodiment, the conveyance amount correction value at the time of transfer of each roller rotation phase section is obtained in advance, and therefore highly accurate conveyance control is performed regardless of the rotation phase section where the conveying operation at the time of transfer is performed during the actual recording operation. In contrast, in this embodiment, the conveyance amount correction value at the time of transfer of each roller rotation phase section is obtained, and then an optimal rotation phase section for the conveying operation at the time of transfer is determined. At the time of the actual recording operation, paper conveyance control is performed so that the conveying operation at the time of transfer is performed in this optimal rotation phase section.

In this embodiment, the rotation phases of the conveying roller 36 and the discharge roller 40 are controlled so that the conveying speeds of the conveying roller 36 and the discharge roller 40 are at or below a predetermined speed when the trailing edge of paper passes through the nip of the conveying roller 36. It is more desirable that control be performed so that the conveying operation at the time of transfer is performed in a rotation phase section such that there is no (or little) difference in conveying speed between the conveying roller 36 and the discharge roller 40. In a recording apparatus in which both bearings for each roller are symmetric to the middle in the width direction of paper, the middle of paper corresponds to the middle of each roller. Therefore, it is optimal that the conveyance amounts (conveying speeds) of the conveying roller 36 and the discharge roller 40 be the same.

First, a description will be given of a method for performing a conveying operation at the time of transfer in a desired rotation phase.

After paper is fed from the paper feed unit and the leading edge thereof is nipped by the conveying roller 36, a conveying operation is performed with substantially no slippage between paper and the conveying roller 36. Therefore, after the leading edge of paper is nipped by the conveying roller 36, the position of paper and the rotation phase of the conveying roller 36 can be unambiguously controlled, and the rotation phase at the time of transfer can be easily estimated. That is to say, the rotation phase in the transfer point B can be controlled by adjusting the roller rotation phase in which the leading edge of fed paper is nipped by the conveying roller 36, in consideration of the length of paper.

Figure 19A:
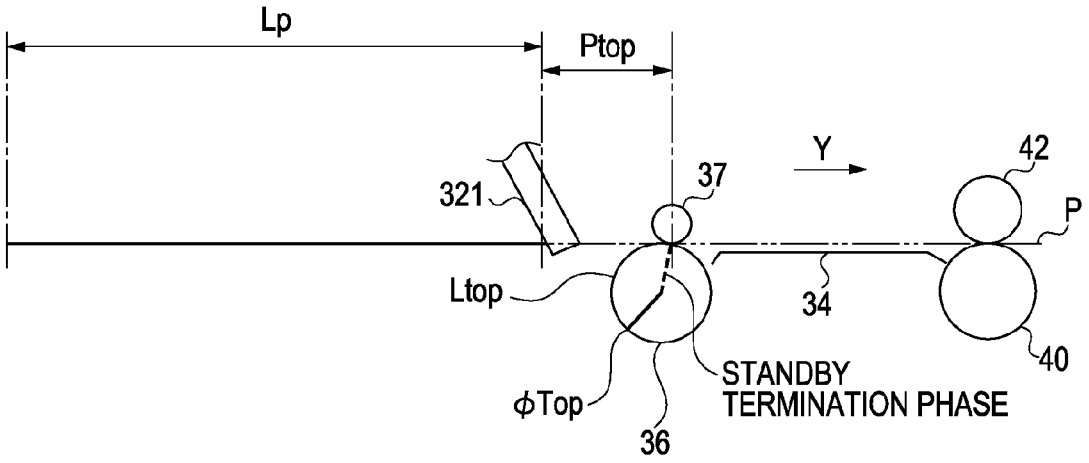
FIG. 19A shows a state where the leading edge of paper is detected.
Figure 19B:
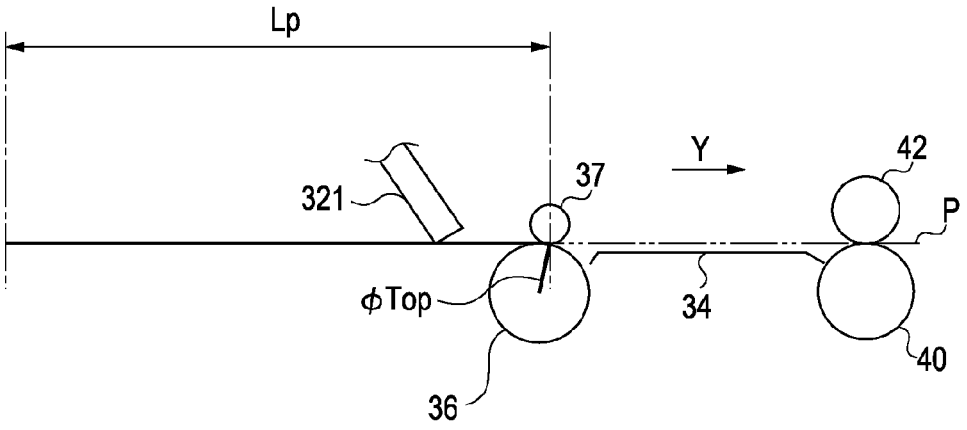
FIG. 19B shows a state where the leading edge of paper is nipped by the conveying roller.
Figure 20:
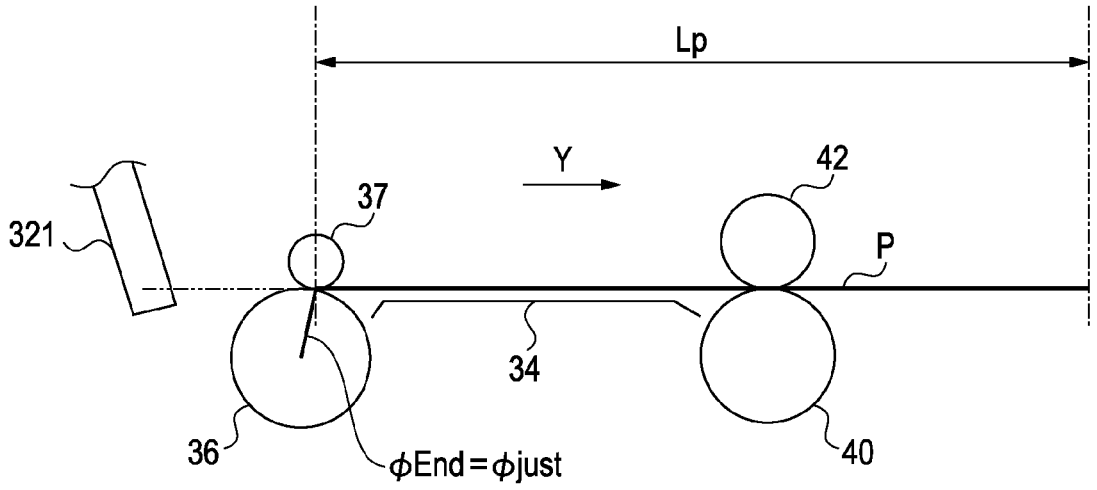
FIG. 20 is a diagram showing a state where the trailing edge of paper has passed through the nip of the conveying roller in an optimal rotation phase $\phi$just.

Next, with reference to FIGS. 19A, 19B, 20, and 21, a description will be given of the conveyance control at the time of transfer in the second embodiment. FIG. 19A shows a state where the leading edge of paper is detected by a lever 321. FIG. 19B shows a state where the leading edge of paper is nipped by the conveying roller 36. FIG. 20 shows a state where the trailing edge of paper has passed through the nip of the conveying roller 36 in an optimal rotation phase $\phi$just.

Figure 21:
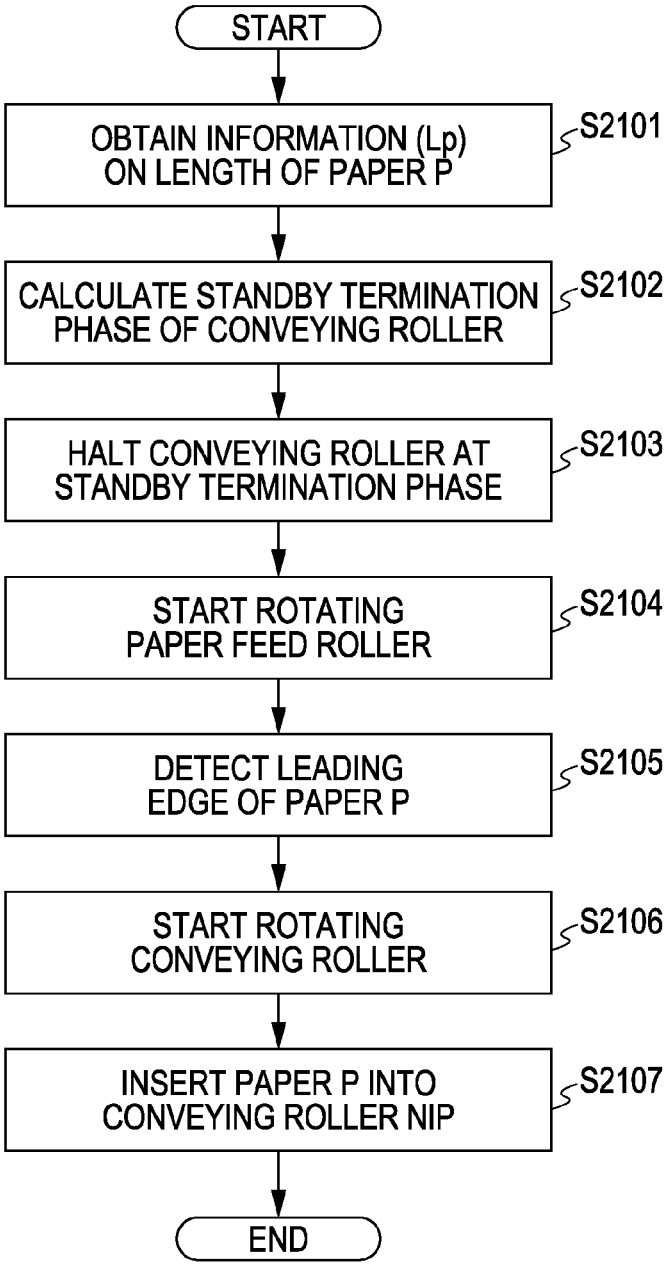
FIG. 21 shows a control flow of the conveyance amount correction at the time of transfer in the recording operation in a second conveyance amount control.

FIG. 21 shows a conveyance control flow at the time of transfer in this embodiment.

Reference is made to FIG. 21. In the step S2101, paper length information Lp is obtained from a printer driver or an input device. The paper length information Lp may be obtained using a sensor in the recording apparatus.

Next, in the step S2102, the initial phase (standby termination phase) in which the rotation of the conveying roller 36 is started is calculated from the obtained paper length information Lp.

Next, the conveying roller 36 is halted in the standby termination phase (step S2103). After that, the paper feed roller 28 is rotated to start the feeding of paper (step S2104). Then, in the step S2105, the fed paper comes into contact with the lever 321 and rotates the lever 321, and the paper leading edge detecting sensor detects the leading edge of the paper. At this time, the distance between the leading edge of the paper and the nip of the conveying roller 36 is Ptop. At this time, the conveying roller 36 starts rotating (step S2106). The conveying roller 36 is rotated at the same speed as the paper feed roller 28 until the paper P reaches the nip of the conveying roller 36, and the paper P is nipped by the conveying roller 36 (step S2107). In this embodiment, the rotation phase at the time of transfer is fixed at this time. Therefore, due to the above control, the roller rotation phase at the time of transfer can be set to the optimal phase $\phi$just.

With reference to FIGS. 19A and 19B, a description will be given of a method for calculating the initial phase (standby termination phase) for performing the conveying operation at the time of transfer in the optimal phase $\phi$just.

The conveyance amount of the paper feed roller 28 from the detection of the leading edge of the paper P to the nipping of the paper P by the conveying roller 36 is Ptop, whereas the conveyance amount of the conveying roller 36 is Ltop, which is smaller than Ptop. The reason is that the paper feed roller 28 is already rotating, whereas the conveying roller 36 starts rotating from a halting state. The Ltop can be unambiguously calculated when the rotation speed of the paper feed roller 28 and the rotation speed of the conveying roller 36 are determined by the recording mode. That is to say, the conveying roller 36 is halted in a rotation phase behind the rotation phase at the time of nipping of the paper P, by an angle corresponding to the conveyance amount Ltop.

The paper P nipped by the conveying roller 36 is transferred to the discharge roller 40 after the conveying roller 36 has rotated by an angle corresponding to the length Lp of the paper (FIG. 20). The phase of the conveying roller 36 is controlled in advance so that the rotation phase of the conveying roller 36 at the time of transfer is an optimal rotation phase.

To perform transfer in an optimal rotation phase $\phi$just of the conveying roller 36, the paper P is nipped in a phase behind the $\phi$just by $(Lp)/(\pi Dr)$. Dr is the effective diameter of the conveying roller 36. Further, a phase behind the optimal phase $\phi$just by $(Lp+Ltop)/(\pi Dr)$ is set as the standby termination phase of the conveying roller 36. By setting the standby termination phase of the conveying roller 36 in consideration of the roller slippage, a stricter conveyance control can be performed.

Thus, the conveying operation at the time of transfer can be performed in an optimal phase ϕjust, and paper can be conveyed stably and with a high degree of accuracy. The production tolerance or temporal change of the main body of the recording apparatus or the difference in paper type can cause an unexpected conveyance error. In this case, the conveying operation at the time of transfer cannot be performed in an optimal phase ϕjust, but the probability thereof can be made very low. In the case where the conveying operation at the time of transfer cannot be performed in an optimal phase ϕjust, the conveyance amount error at that time can be reduced by applying a correction value corresponding to the rotation phase at the time of transfer as described in the first embodiment.

This embodiment can be easily applied just by performing the above-described control flow at the time of paper feeding in addition to always performing the conveyance amount control of the first embodiment.

The optimal phase ϕjust varies depending on the length and setting of roller. As described above, when the middle of paper corresponds to the midpoint between bearings at both ends of roller, an optimal phase ϕjust is a rotation phase such that there is no (or little) difference in conveying speed between the conveying roller 36 and the discharge roller 40 when the trailing edge of paper passes through the nip of the conveying roller 36.

When a discharge assist roller 41 configured to accelerate relative to the discharge roller 40 is provided, and the middle of paper does not correspond to the midpoint between bearings at both ends of roller, the conveyance amount is not stabilized by eliminating the difference in conveying speed between the conveying roller 36 and the discharge roller 40. The reason is that just after the paper passes through the nip, due to the deflection of the discharge roller 40, the paper moves downstream under the influence of the difference in the roller axial direction. Such a phenomenon is significant especially when a discharge assist roller 41 is configured to accelerate relative to the discharge roller 40. In such a case, a phase is selected such that the discharge roller 40 serves as a decelerating system relative to the conveying roller 36, and the discharge roller 40 is deflected downstream in advance. It is effective to counteract the effect of the release from deflection in this way.

As described above, in this embodiment, by setting an optimal phase ϕjust at the time of transfer according to the configuration of the main body of the recording apparatus, a conveying operation at the time of transfer can be performed with a higher degree of accuracy.

Third Embodiment

This embodiment is the second embodiment to which a learning effect is applied. The conveyance at the time of transfer is not always performed in ϕjust due to the production tolerance of the main body of the recording apparatus, changes in usage environment (temperature and humidity), a reduction in conveyance amount of the paper feed roller due to temporal change, or the difference in type of paper that a user uses. This embodiment can handle such a problem.

In this embodiment, if the actual phase ϕEnd when paper passes through the nip deviates from an optimal phase ϕjust with a tendency, the initial phase or the nipping phase is appropriately offset.

Whether or not the actual phase ϕEnd of the conveying operation at the time of transfer is equal to the optimal phase ϕjust can be easily determined after the conveying operation, and the amount of phase error can also be calculated.

The deviation of the actual phase ϕEnd at the time of transfer from the optimal phase ϕjust is monitored with respect to each of conditions such as recording mode, type and size of paper selected, and usage history. The results are stored in a memory such as an SRAM or EEPROM in the recording apparatus. When the accumulated number of times of deviation of the actual phase ϕEnd at the time of transfer from the optimal phase ϕjust exceeds a predetermined threshold value, the initial phase (standby termination phase) is changed by an expected value of deviation of the actual phase ϕEnd at the time of transfer from the optimal phase ϕjust.

As described above, in this embodiment, by adjusting the deviation from the optimal phase ϕjust according to the temporal change and paper type, the conveying operation at the time of transfer can be performed with a higher degree of accuracy.

Instead of adjusting the deviation from the optimal phase ϕjust by changing the standby termination phase, adjustment may be performed using the amount of reverse rotation of the conveying roller 36 during the registration operation during the feeding of paper.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A recording apparatus comprising:

a recording head configured to record an image on a recording medium;

a first conveying roller configured to convey the recording medium and is disposed upstream of the recording head in a conveying direction of the recording medium;

a pinch roller configured to nip the recording medium in cooperation with the first conveying roller to convey the recording medium;

a second conveying roller configured to convey the recording medium and is disposed downstream of the recording head in the conveying direction; and a determining unit configured to determine a rotation phase of the first conveying roller when a leading edge of a recording medium is nipped at a nip portion between the first conveying roller and the pinch roller such that the difference between the conveyance speed by the first conveying roller and the conveyance speed by the second conveying roller is smaller than a predetermined value when a trailing edge of the recording medium passes the nip portion based on length information of the recording medium.

2. The recording apparatus according to claim 1, wherein the determining unit determines the rotation phase such that the difference between the conveyance amount by the first conveying roller and the conveyance amount by the second conveying roller is smaller than a predetermined value when a trailing edge of the recording medium passes the nip portion.

3. The recording apparatus according to claim 1, wherein the controller controls rotation phases of the first conveying roller and the second conveying roller in the third conveying operation, at a predetermined position where a trailing edge of the recording medium leaves the first conveying roller.

4. The recording apparatus according to claim 1, wherein a rotation ratio between the first conveying roller and the second conveying roller is 1:1.

5. The recording apparatus according to claim 1, wherein a rotation ratio between the first conveying roller and a drive transmitting unit which transmits a drive from the first conveying roller to the second conveying roller is 1:1.

6. The recording apparatus according to claim 1, further comprising a third conveying roller disposed between the first conveying roller and the second conveying roller, wherein the conveying speed of the third conveying roller is higher than the conveying speed of the second conveying roller, and the recording medium conveying power of the third conveying roller is smaller than the recording medium conveying power of the second conveying roller.

7. The recording apparatus according to claim 1, further comprising a feed unit for feeding the recording medium to the first conveying roller, and a pinch roller for nipping the recording medium in corporation with the first conveying roller, wherein the controller starts rotation of the first conveying roller such that the first conveying roller starts to convey the recording medium fed by the feed unit in the start phase.

* * * * *